US010529550B1

(12) United States Patent
McCauley et al.

(10) Patent No.: US 10,529,550 B1
(45) Date of Patent: Jan. 7, 2020

(54) ADJUSTABLE MULTIPOLE ASSEMBLY FOR A MASS SPECTROMETER

(71) Applicant: Thermo Finnigan LLC, San Jose, CA (US)

(72) Inventors: Edward B. McCauley, Cedar Park, TX (US); Scott T. Quarmby, Round Rock, TX (US); George B. Guckenberger, Austin, TX (US); James M. Hitchcock, Pflugerville, TX (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 16/032,658

(22) Filed: Jul. 11, 2018

(51) Int. Cl.
*H01J 49/42* (2006.01)
*H01J 49/06* (2006.01)

(52) U.S. Cl.
CPC ..... *H01J 49/4225* (2013.01); *H01J 49/063* (2013.01); *H01J 49/068* (2013.01); *H01J 49/429* (2013.01); *H01J 49/4275* (2013.01); *H01J 49/4295* (2013.01)

(58) Field of Classification Search
CPC .. H01J 49/063; H01J 49/4215; H01J 49/4255; H01J 9/14; H01J 49/068; H01J 49/4225; H01J 49/0013; H01J 49/0018; H01J 49/0404; H01J 49/421; G01N 27/624; G01N 27/622; H01L 41/047; H01L 41/0477; H01L 41/18
USPC ..... 250/288, 281, 287, 292, 282, 283, 284, 250/286, 293
See application file for complete search history.

(56) References Cited

U.S. PATENT DOCUMENTS 5,198,666 A 3/1993 Bateman
6,396,057 B1 * 5/2002 Jarrell ..... H01J 49/0018 250/288
6,926,783 B2 * 8/2005 Loucks, Jr. ..... H01J 9/14 156/294
7,217,921 B2 * 5/2007 Guevremont ..... G01N 27/624 250/281
7,227,132 B2 * 6/2007 Guervremont ..... G01N 27/624 250/286
7,247,846 B2 7/2007 Buttrill, Jr.
7,351,963 B2 * 4/2008 Rebettge ..... H01J 9/14 250/292
7,365,319 B2 4/2008 Hager et al.
(Continued)

FOREIGN PATENT DOCUMENTS

CN 101385116 A 3/2009

OTHER PUBLICATIONS

Asvany et al., "Note: New design of a cryogenic linear radio frequency multipole trap", Review of Scientific Instruments, vol. 81 (7), p. 076102.

(Continued)

*Primary Examiner* — David A Vanore
(74) *Attorney, Agent, or Firm* — David A. Schell

(57) ABSTRACT

A multipole assembly configured to be disposed in a mass spectrometer includes a plurality of elongate electrodes arranged about an axis extending along a longitudinal trajectory of the plurality of elongate electrodes and configured to confine ions radially about the axis, and a piezoelectric actuator configured to adjust a position of a first electrode included in the plurality of elongate electrodes.

25 Claims, 17 Drawing Sheets

(56) References Cited

U.S. PATENT DOCUMENTS

| | | | | |
|---|---|---|---|---|
| 7,417,225 | B2 * | 8/2008 | Guevremont | G01N 27/624 250/281 |
| 7,491,932 | B2 * | 2/2009 | Thakur | H01J 49/063 250/284 |
| 7,547,878 | B2 * | 6/2009 | Schultz | G01N 27/622 250/281 |
| 7,638,766 | B1 | 12/2009 | Schoen | |
| 8,492,713 | B2 | 7/2013 | Steiner et al. | |
| 8,507,847 | B2 * | 8/2013 | Wright | H01J 49/063 250/281 |
| 8,558,167 | B2 * | 10/2013 | Wright | H01J 49/0013 250/281 |
| 9,099,290 | B2 | 8/2015 | Jung et al. | |
| 9,892,899 | B2 | 2/2018 | Gill et al. | |
| 2013/0015341 | A1 * | 1/2013 | Steiner | H01J 49/4255 250/281 |
| 2013/0015347 | A1 | 1/2013 | Steiner | |
| 2013/0106242 | A1 * | 5/2013 | Shibata | C04B 35/495 310/311 |
| 2018/0174818 | A1 * | 6/2018 | Roberts | H01J 49/063 |

OTHER PUBLICATIONS

Loboda et al., "Novel Linac II electrode geometry for creating an axialfield in a multipole ion guide", European Journal of Mass Spectrometry, IM Publications 2000, vol. 6 (6), pp. 531-536.

* cited by examiner

ADJUSTABLE MULTIPOLE ASSEMBLY FOR A MASS SPECTROMETER

BACKGROUND INFORMATION

A mass spectrometer is an analytical tool that may be used for qualitative and/or quantitative analysis of a sample. A mass spectrometer generally includes an ion source for generating ions from the sample, a mass analyzer for separating the ions based on their ratio of mass to charge, and an ion detector for detecting the separated ions. The mass spectrometer uses data from the ion detector to construct a mass spectrum that shows a relative abundance of each of the detected ions as a function of their ratio of mass to charge. By analyzing the mass spectrum generated by the mass spectrometer, a user may be able to identify substances in a sample, measure the relative or absolute amounts of known components present in the sample, and/or perform structural elucidation of unknown components.

Virtually all mass spectrometers include one or more multipole assemblies having a plurality of electrodes for use in guiding, trapping, and/or filtering ions. As an example, a multipole assembly may be a quadrupole having four rod electrodes, arranged as two opposing pairs. Opposite phases of radio-frequency (RF) voltage may be applied to the pairs of rod electrodes, thereby generating a quadrupolar electric field that guides or traps ions within a center region of the quadrupole. In quadrupole mass filters, a mass resolving direct current (DC) voltage is also applied to the pairs of rod electrodes, thereby superimposing a DC electric field on the quadrupolar electric field and causing a trajectory of some ions to become unstable and causing the ions to discharge against one of the rod electrodes. In such mass filters, only ions having a certain ratio of mass to charge will maintain a stable trajectory and traverse the length of the quadrupole, such that they are subsequently detected by the ion detector.

In multipole assemblies, the precision of the electric field (i.e., the degree to which the field approximates a desired, "pure" field) depends on the shape, position, and alignment of the electrodes. Electric field faults, which may arise from poor alignment of the electrodes or departures of the electrode shape and/or size from an ideal form, may cause excessive losses of ions when the multipole assembly is employed as an ion guide or ion trap, or poor resolution, sensitivity, and/or mass accuracy when the multipole assembly is utilized in a mass analyzer. Machining and aligning a multipole assembly with the small tolerances necessary to generate a highly precise electric field can be difficult and expensive, and conditions existing within a mass spectrometer can cause the relative positioning and alignment of the electrodes to change over time.

SUMMARY

In some exemplary embodiments, a multipole assembly configured to be disposed in a mass spectrometer includes a plurality of elongate electrodes arranged about an axis extending along a longitudinal trajectory of the plurality of elongate electrodes and configured to confine ions radially about the axis, and a piezoelectric actuator configured to adjust a position of a first electrode included in the plurality of elongate electrodes.

In some exemplary embodiments, the piezoelectric actuator is configured to adjust a parallel alignment of the first electrode with respect to a second electrode included in the plurality of elongate electrodes.

In some exemplary embodiments, the multipole assembly forms all or part of an ion guide, a mass filter, a collision cell, or an ion trap.

In some exemplary embodiments, the first electrode and a second electrode included in the plurality of elongate electrodes are separated from each other across the axis along a first direction, and the piezoelectric actuator is configured to adjust the position of the first electrode substantially along the first direction.

In some exemplary embodiments, the piezoelectric actuator includes a shear stack and is further configured to adjust the position of the first electrode along another direction substantially orthogonal to the first direction.

In some exemplary embodiments, the multipole assembly further includes an additional piezoelectric actuator configured to adjust a position of a third electrode included in the plurality of elongate electrodes.

In some exemplary embodiments, the third electrode and a fourth electrode included in the plurality of elongate electrodes are separated from each other across the axis along a second direction substantially orthogonal to the first direction, and the additional piezoelectric actuator is configured to adjust the position of the third electrode substantially along the second direction.

In some exemplary embodiments, the multipole assembly further includes an insulator configured to electrically insulate the piezoelectric actuator from the plurality of elongate electrodes.

In some exemplary embodiments, the piezoelectric actuator is shielded from an electrical field generated by the plurality of elongate electrodes.

In some exemplary embodiments, the piezoelectric actuator is under an axial preload.

In some exemplary embodiments, the multipole assembly includes a support member configured to hold the plurality of elongate electrodes about the axis, wherein the piezoelectric actuator is positioned between the support member and the first electrode.

In some exemplary embodiments, the multipole assembly includes a support member configured to hold the plurality of elongate electrodes about the axis. The support member is positioned between the piezoelectric actuator and the first electrode, and the piezoelectric actuator is configured to adjust the position of the first electrode by at least one of deforming the support member and adjusting a position of the support member.

In some exemplary embodiments, the piezoelectric actuator is configured to adjust the position of the first electrode to adjust at least one of a concentricity alignment and an angular alignment of the multipole assembly with an incoming ion beam or an ion detector.

In some exemplary embodiments, the piezoelectric actuator is configured to adjust the position of the first electrode to adjust a longitudinal alignment of the first electrode with respect to a second electrode included in the plurality of elongate electrodes.

In some exemplary embodiments, the multipole assembly includes a first printed circuit board and a second printed circuit board positioned opposite one another with a gap therebetween, wherein the first electrode is arranged on the first printed circuit board and the piezoelectric actuator is configured to adjust the position of the first electrode by adjusting the position of the first printed circuit board.

In some exemplary embodiments, the piezoelectric actuator is configured to adjust a parallel alignment of the first printed circuit board with respect to the second printed circuit board by adjusting a position of the first printed circuit board.

In some exemplary embodiments, a mass spectrometer includes an ion source configured to produce ions from a sample, a mass analyzer configured to filter the ions produced from the sample, and a detector configured to detect ions delivered from the mass analyzer. The mass analyzer includes a multipole assembly having a plurality of electrodes arranged about an axis extending along a longitudinal trajectory of the plurality of elongate electrodes and configured to confine the ions radially about the axis, and a piezoelectric actuator configured to adjust a position of a first electrode included in the plurality of electrodes.

In some exemplary embodiments, the mass spectrometer further includes an oscillatory voltage power supply coupled to the plurality of electrodes and configured to supply an RF voltage to the plurality of electrodes, a DC power supply coupled to the piezoelectric actuator and configured to supply a DC control voltage to the piezoelectric actuator, and a controller coupled to the oscillatory voltage power supply and the DC power supply. The controller is configured to control the oscillatory voltage power supply to supply the RF voltage to the plurality of electrodes, and control the DC power supply to supply the DC control voltage to the piezoelectric actuator to adjust the position of the first electrode.

In some exemplary embodiments, the controller is configured to control the DC power supply to supply the DC control voltage to the piezoelectric actuator by accessing, from a storage device communicatively coupled to the controller, a predetermined calibration value indicative of a DC voltage level configured to bring the first electrode into a preset alignment with a second electrode included in the plurality of elongate electrodes, and adjusting the DC control voltage to the predetermined calibration value.

In some exemplary embodiments, the DC power supply is further coupled to the plurality of electrodes and configured to supply a mass resolving DC voltage to the plurality of electrodes. The controller is further configured to control filtering of the ions produced from the sample based on a ratio of mass to charge of the ions by controlling the oscillatory voltage power supply and the DC power supply to supply, to the plurality of electrodes, a range of RF voltages and mass resolving DC voltages over time during a scan of a range of ratios of mass to charge, and dynamically vary the position of the first electrode by controlling the DC power supply to vary, over time during the scan of the range of ratios of mass to charge, the DC control voltage supplied to the piezoelectric actuator.

In some exemplary embodiments, the mass spectrometer further includes a sensor configured to detect an operating condition of the multipole assembly. The controller is configured to detect a change in the operating condition of the multipole assembly, and actuate, in response to the detection of the change in the operating condition of the multipole assembly, the piezoelectric actuator to adjust the position of the first electrode.

In some exemplary embodiments, the sensor comprises at least one of a temperature sensor configured to detect a temperature of the multipole assembly, a strain gauge configured to detect the position of the first electrode, and a piezoelectric transducer configured to detect the position of the first electrode.

Some exemplary embodiments described herein disclose a method of operating a mass spectrometer having a multipole assembly comprising a plurality of elongate electrodes arranged about an axis extending along a longitudinal trajectory of the plurality of elongate electrodes and configured to confine ions radially about the axis, and a piezoelectric actuator configured to adjust a position of a first electrode included in the plurality of elongate electrodes. The method includes actuating the piezoelectric actuator to adjust the position of the first electrode.

In some exemplary embodiments, the method of operating the mass spectrometer further includes filtering ions produced from a sample based on a ratio of mass to charge of the ions by applying a range of RF voltages and mass resolving DC voltages over time to the plurality of elongate electrodes during a scan of a range of ratios of mass to charge. The actuating of the piezoelectric actuator includes applying a DC control voltage to the piezoelectric actuator during the scan of the range of ratios of mass to charge.

In some exemplary embodiments, the method of operating the mass spectrometer further includes detecting a change in temperature of the multipole assembly and changing, in response to detection of the change in temperature of the multipole assembly, the DC control voltage applied to the piezoelectric actuator during the scan of the range of ratios of mass to charge.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
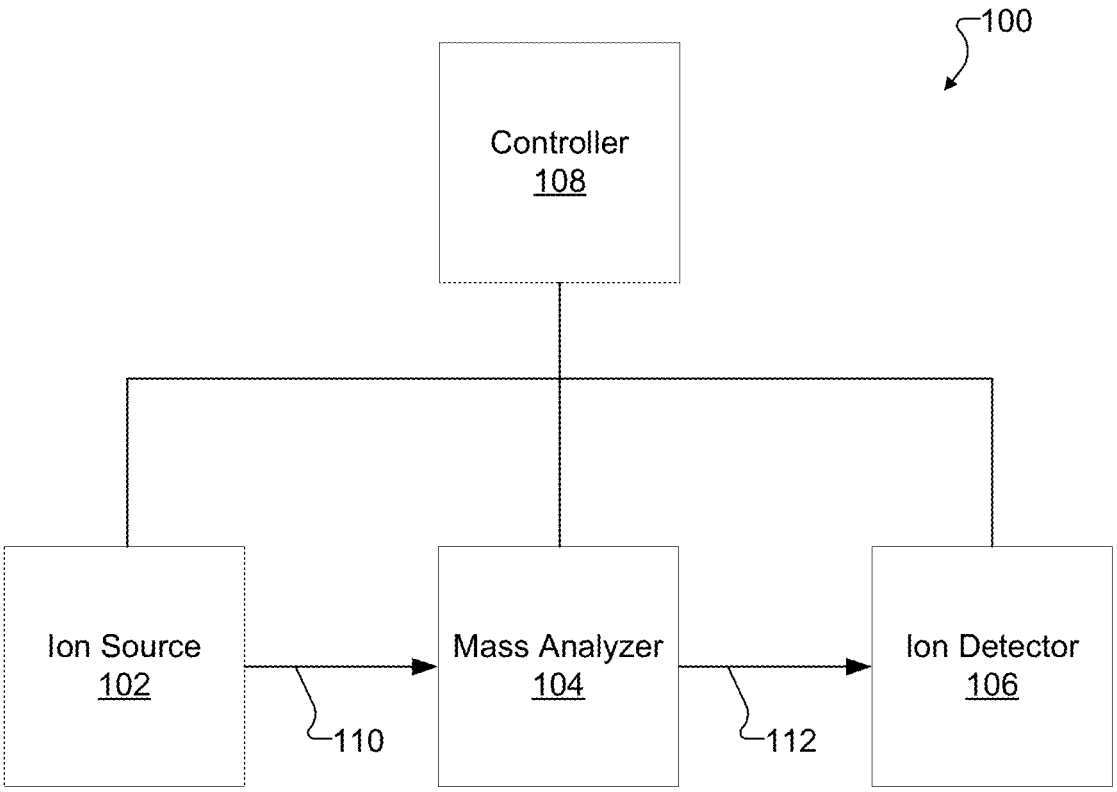
FIG. 1 illustrates an exemplary mass spectrometry system according to principles described herein.

As will be described herein in detail, a multipole assembly for use in a mass spectrometry system may include a plurality of elongate electrodes arranged about an axis extending along a longitudinal trajectory of the plurality of elongate electrodes. The plurality of elongate electrodes may be configured to confine ions radially about the axis. The multipole assembly includes a piezoelectric actuator configured to adjust a position of an electrode included in the plurality of elongate electrodes.

The piezoelectric actuator may adjust the position of the electrode with respect to another electrode included in the plurality of elongate electrodes. For example, a parallel alignment of a first electrode and a second electrode may be adjusted. Such an adjustment may improve uniformity of an electric field generated along the longitudinal trajectory of the electrodes. As another example, a longitudinal alignment of a first electrode and a second electrode may be adjusted. Such an adjustment may improve uniformity of the electric field encountered by ions entering the multipole assembly. Furthermore, the piezoelectric actuator may be configured to bring the multipole assembly into an angular alignment and/or a concentricity alignment with an ion beam transmitted from an ion source such that the ion beam transmitted from the ion source is parallel to the longitudinal trajectory of the electrodes and/or is centered on the axis of the multipole assembly.

A multipole assembly having a piezoelectric actuator configured to adjust the position of an electrode allows the multipole assembly to be manufactured with larger tolerances than multipole assemblies without a piezoelectric actuator because the piezoelectric actuator can be used to make fine (e.g., about 20μ less) alignment adjustments (e.g., parallel alignment adjustments, longitudinal alignment adjustments, concentricity alignment adjustments, and angular alignment adjustments). Thus, the cost of manufacturing a multipole assembly can be reduced while maintaining high resolution. Additionally, in high precision multipole assemblies manufactured with small tolerances (e.g., within about 5μ), a piezoelectric actuator configured to adjust a position of an electrode can improve alignment of electrodes with smaller tolerances and yield higher resolution than previously possible with multipole assemblies without a piezoelectric actuator. Furthermore, a wider range of materials can be used for multipole assembly components (e.g., an electrode, a support member, etc.) than in a conventional multipole assembly because the piezoelectric actuator can make positional adjustments to respond to thermal expansion of the various components. Accordingly, less expensive materials and/or materials that are easier to machine and process can be used.

Various embodiments will now be described in more detail with reference to the figures. The exemplary multipole assemblies described herein may provide one or more of the benefits mentioned above and/or various additional and/or alternative benefits that will be made apparent herein.

A multipole assembly described herein may be implemented as part of, or in conjunction with, a mass spectrometry system. FIG. 1 illustrates functional components of an exemplary mass spectrometry system 100 ("system 100"). The exemplary system 100 is illustrative and not limiting. As shown, system 100 includes an ion source 102, a mass analyzer 104, an ion detector 106, and a controller 108.

Ion source 102 is configured to produce a plurality of ions from a sample to be analyzed and to deliver the ions to mass analyzer 104. Ion source 102 may use any suitable ionization technique, including electron ionization (EI), chemical ionization (CI), matrix assisted laser desorption/ionization (MALDI), electrospray ionization (ESI), atmospheric pressure chemical ionization (APCI), atmospheric pressure photoionization (APPI), inductively coupled plasma (ICP), and the like. Ion source 102 may focus and accelerate an ion beam 110 of produced ions from ion source 102 to mass analyzer 104.

Mass analyzer 104 is configured to separate the ions in ion beam 110 according to the ratio of mass to charge of each of the ions. To this end, mass analyzer 104 may include a quadrupole mass filter (not shown in FIG. 1), an ion trap (e.g., a three-dimensional (3D) quadrupole ion trap, a cylindrical ion trap, a linear quadrupole ion trap, a toroidal ion trap, etc.), a time-of-flight (TOF) mass analyzer, an electrostatic trap mass analyzer, a Fourier transform ion cyclotron resonance (FT-ICR) mass analyzer, a sector mass analyzer, and the like.

In some embodiments that implement tandem mass spectrometers, mass analyzer 104 and/or ion source 102 may also include a collision cell (not shown in FIG. 1). The term "collision cell," as used herein, is intended to encompass any structure arranged to produce product ions via controlled dissociation processes and is not limited to devices employed for collisionally-activated dissociation. For example, a collision cell may be configured to fragment the ions using collision induced dissociation (CID), electron transfer dissociation (ETD), electron capture dissociation (ECD), photo induced dissociation (PID), surface induced dissociation (SID), and the like. A collision cell may be positioned upstream from a mass filter, which separates the fragmented ions based on the ratio of mass to charge of the ions. In some embodiments, mass analyzer 104 may include a combination of multiple mass filters and/or collision cells, such as a triple quadrupole mass analyzer, where a collision cell is interposed in the ion path between independently operable mass filters.

Ion detector 106 is configured to detect ions separated by mass analyzer 104 and responsively generate a signal representative of ion abundance. In one example, mass analyzer 104 emits an emission beam 112 of separated ions to ion detector 106, which is configured to detect the ions in emission beam 112 and generate or provide data that can be used to construct a mass spectrum of the sample. Ion detector 106 may include, but is not limited to, an electron multiplier, a Faraday cup, and the like.

Ion source 102 and/or mass analyzer 104 may include ion optics (not shown in FIG. 1) for focusing, accelerating, and/or guiding ions (e.g., ion beam 110 or emission beam 112) through system 100. The ion optics may include, for example, an ion guide, a focusing lens, a deflector, and the like. For instance, ion source 102 may include ion optics for focusing the produced ions into ion beam 110, accelerating ion beam 110, and guiding ion beam 110 toward mass analyzer 104.

Any one or more of ion source 102, mass analyzer 104, and ion detector 106 may include a multipole assembly having a plurality of elongate electrodes and a piezoelectric actuator configured to adjust a position of an electrode included in the plurality of elongate electrodes, as will be described below in more detail. Such a multipole assembly may, for example, form all or part of a mass filter, an ion trap, a collision cell, and/or ion optics (e.g., an ion guide). The multipole assembly may be coupled to an oscillatory voltage power supply (not shown) configured to supply an RF voltage to the plurality of elongate electrodes. The multipole assembly may also be coupled to a DC power supply (not shown) configured to supply, for example, a mass resolving DC voltage to the plurality of elongate electrodes and/or a DC control voltage to the piezoelectric actuator.

Controller 108 may be communicatively coupled with, and configured to control operations of, ion source 102, mass analyzer 104, and/or ion detector 106. Controller 108 may include hardware (e.g., a processor, circuitry, etc.) and/or software configured to control operations of the various components of system 100. For example, controller 108 may be configured to enable/disable ion source 102. Controller 108 may also be configured to control the oscillatory voltage power supply to supply the RF voltage to the multipole assembly, and to control the DC power supply to supply the mass resolving DC voltage to the multipole assembly. Controller 108 may also be configured to control mass analyzer 104 by selecting an effective range of the ratio of mass to charge of ions to detect. Controller 108 may further be configured to adjust the sensitivity of ion detector 106, such as by adjusting the gain, or to adjust the polarity of ion detector 106 based on the polarity of the ions being detected.

Controller 108 may also be configured to control operation of the piezoelectric actuator included in the multipole assembly. As an example, controller 108 may be configured to control the DC power supply to supply the DC control voltage to the piezoelectric actuator in order to adjust a position of an electrode in the multipole assembly and/or to adjust a position of the multipole assembly itself. Various operations and methods of control of the piezoelectric actuator included in the multipole assembly will be described below in more detail.

Various embodiments of a multipole assembly that may be used in system 100 will now be described. It will be recognized that the embodiments that follow are merely exemplary and are not limiting.

Figure 2:
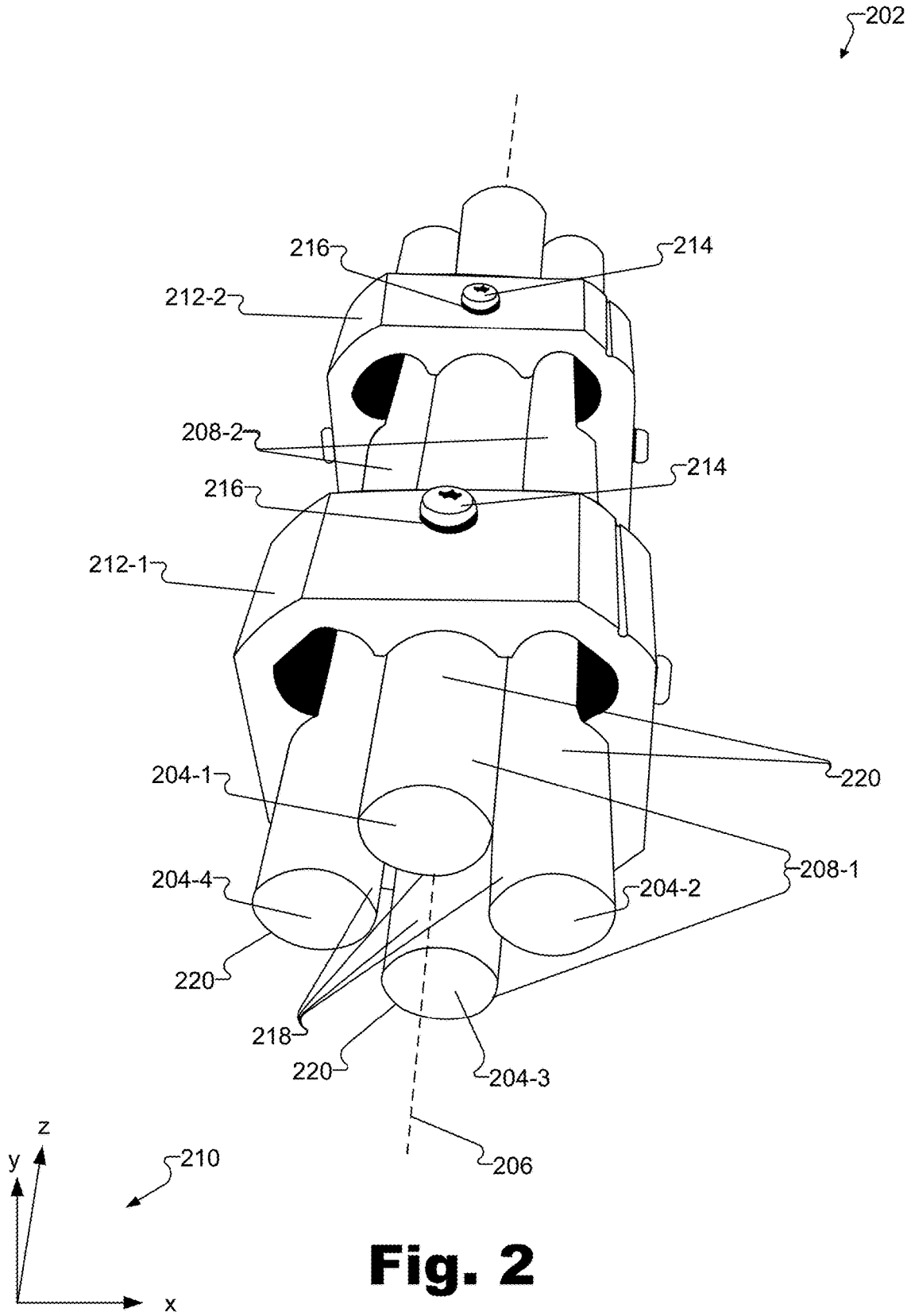
FIGS. 2-4 illustrate an exemplary multipole assembly that may be included within the mass spectrometry system of FIG. 1 according to principles described herein.

FIG. 2 shows a perspective view of an exemplary multipole assembly that may be used in system 100. As shown in FIG. 2, the multipole assembly may be a quadrupole 202 having four circular elongate rod electrodes 204 (e.g., first electrode 204-1, second electrode 204-2, third electrode 204-3, and fourth electrode 204-4) arranged about an axis 206 extending along a longitudinal trajectory of electrodes 204. Electrodes 204 are arranged as opposing electrode pairs 208 (e.g., a first electrode pair 208-1 and a second electrode pair 208-2) across axis 206. For example, first electrode pair 208-1 includes first electrode 204-1 positioned opposite to third electrode 204-3, and second electrode pair 208-2 includes second electrode 204-2 positioned opposite to fourth electrode 204-4. Electrodes 204 may be formed of any conductive material, such as a metal (e.g., molybdenum, nickel, titanium), a metal alloy (e.g., invar, steel), and the like.

FIG. 2 shows a three-dimensional (3D) coordinate system 210 relative to quadrupole 202. In 3D coordinate system 210, the z-axis corresponds to axis 206, first electrode 204-1 and third electrode 204-3 are positioned on the y-axis, and second electrode 204-2 and fourth electrode 204-4 are positioned on the x-axis.

Quadrupole 202 includes rigid support members 212 (e.g., first support member 212-1 and second support member 212-2) to hold electrodes 204. First support member 212-1 may be located at a proximal end portion of quadrupole 202 (e.g., at an ion beam receiving side), and second support member 212-2 may be located at a distal end portion of quadrupole 202 (e.g., at an ion beam emission side). The support members 212 illustrated in FIG. 2 are exemplary. Additional or alternative rigid support members 212 may be used in other examples to hold electrodes 204.

Electrodes 204 may be secured to support members 212 by a fastener and/or adhesive. For example, an electrode 204 may be secured to a support member 212 by a set screw 214 that passes through a screw hole (not shown) in support member 212 and attaches to electrode 204. A washer 216 may be provided between support member 212 and set screw 214. Washer 216 may be any type of washer or mechanism that allows movement of set screw 214, as will be explained below. For example, washer 216 may include, but is not limited to, a spring, a spring washer, a wave washer, a three wave washer, a Belleville washer, a cone spring, and the like.

As shown in FIG. 2, facing surfaces 218 of electrodes 204 (i.e., surfaces of electrodes 204 that face opposing electrodes 204 across axis 206) and backside surfaces 220 (i.e., surfaces of electrodes 204 that face support members 212) are round, although in other embodiments they may be flat or any other suitable shape.

Figure 3:
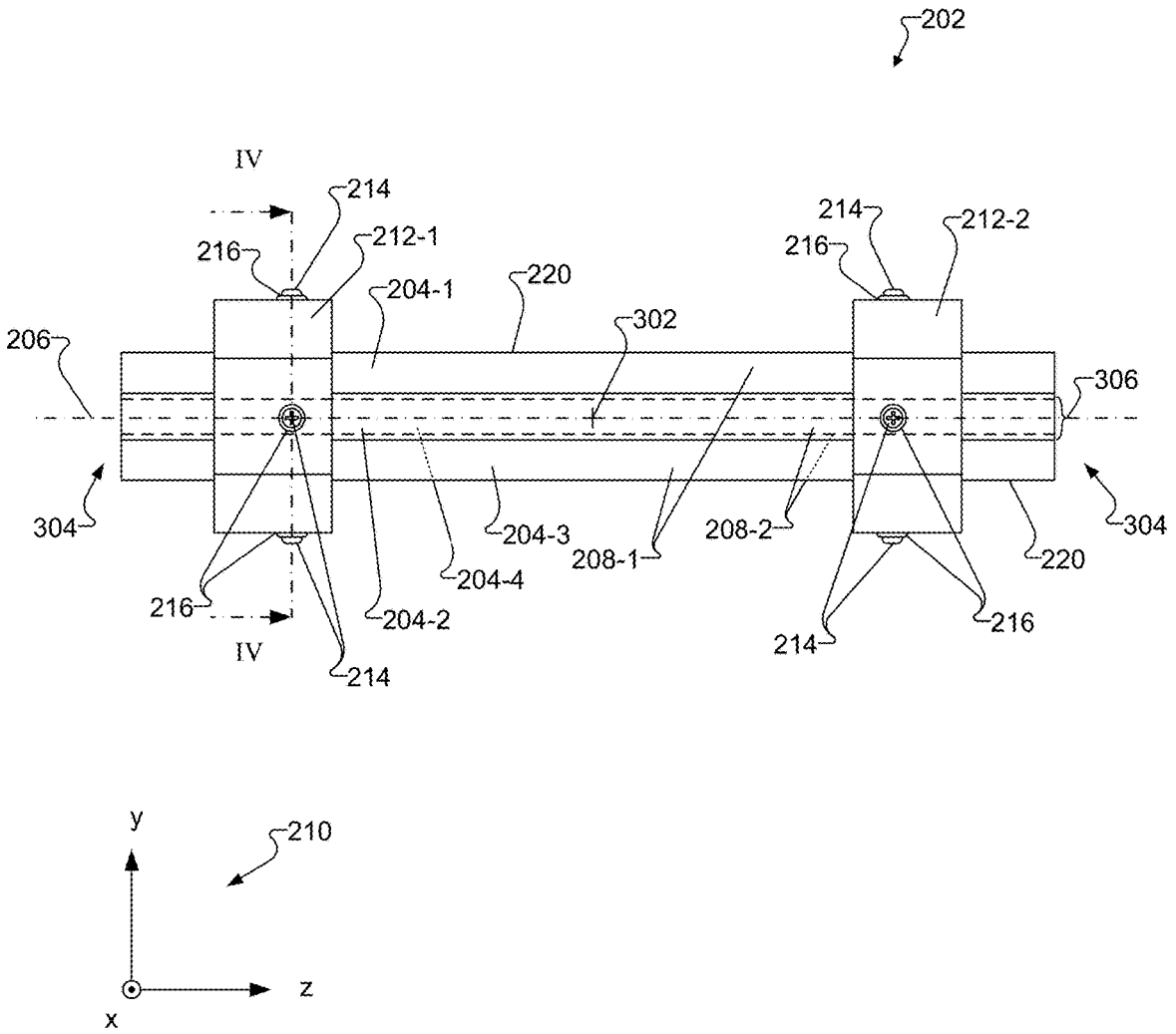

FIG. 3 shows a side view of quadrupole 202 shown in FIG. 2. In FIG. 3, 3D coordinate system 210 is shown relative to quadrupole 202. For purposes of this description, the origin of 3D coordinate system 210 is a center point 302 of quadrupole 202, i.e., a point that is radially equidistant from first electrode 204-1, second electrode 204-2, third electrode 204-3, and fourth electrode 204-4 in the x-direction and the y-direction, and that is longitudinally equidistant from end faces 304 of electrodes 204. First electrode 204-1 is positioned away from center point 302 in a +y-direction, second electrode 204-2 is positioned away from center point 302 in a +x-direction, third electrode 204-3 is positioned away from center point 302 in a −y-direction, and fourth electrode 204-4 is positioned away from center point 302 in a −x-direction. A proximal end portion of quadrupole 202 is positioned away from center point 302 in a −z-direction, and a distal end portion of quadrupole 202 is positioned away from center point 302 in a +z-direction. As used herein, "x-direction" refers to the +x-direction and/or the −x-direction, "y-direction" refers to the +y-direction and/or the −y-direction, and "z-direction" refers to the +z-direction and/or the −z-direction.

During operation of quadrupole 202, opposite phases of radio-frequency (RF) voltage may be applied to electrode pairs 208 to generate an RF quadrupolar electric field that guides or traps ions within stability region 306 of quadrupole 202. Stability region 306 is a region between electrode pairs 208 where ions may be confined radially about axis 206 such that the confined ions do not contact or discharge against any of electrodes 204. As the RF voltage oscillates, the ions are alternately attracted to first electrode pair 208-1 and second electrode pair 208-2, thus confining the ions within stability region 306.

In some embodiments, quadrupole 202 may function as a mass resolving quadrupole, i.e., a quadrupole configured to separate ions based on their ratio of mass to charge. Accordingly, a mass resolving DC voltage may also be applied to electrode pairs 208, thereby superposing a constant electric field on the RF quadrupolar electric field. The constant electric field generated by the mass resolving DC voltage causes the trajectory of ions having a ratio of mass to charge outside of an effective range to become unstable such that the unstable ions eventually discharge against one of the electrodes 204 and are not detected by the ion detector (e.g., ion detector 106). Only ions having a ratio of mass to charge within the effective range maintain a stable trajectory in the presence of the mass resolving DC voltage and are confined radially about axis 206 within stability region 306, thus separating such ions to be detected by the ion detector.

The symmetry and uniformity of the RF and DC electric fields generated by electrodes 204 depends on the alignment of electrodes 204. As used herein, rod electrodes in a "parallel alignment" with one another are parallel in a common plane and are not skew with one another. For example, first electrode 204-1 and third electrode 204-3 of first electrode pair 208-1 may be in a parallel alignment with one another in the yz plane. Similarly, second electrode 204-2 and fourth electrode 204-4 of second electrode pair 208-2 may be in a parallel alignment with one another in the xz plane. Electrodes 204 in a parallel alignment may also be in different electrode pairs 208. For example, first electrode 204-1 and second electrode 204-2 may be in a parallel alignment with one another in a plane that intersects the +xz plane and the +yz plane, and third electrode 204-3 and fourth electrode 204-4 may be in a parallel alignment with one another in a plane that intersects the −xz plane and the −yz plane. Similarly, first electrode 204-1 and fourth electrode 204-4 may be in a parallel alignment with one another in a plane that intersects the −xz plane and the +yz plane, and second electrode 204-2 and third electrode 204-3 may be in a parallel alignment with one another in a plane that intersects the +xz plane and the −yz plane. In this way, all of the electrodes 204 may be in a parallel alignment with one another.

It should be noted that, as used herein, terms such as "parallel," "aligned," and "orthogonal" are not intended to require absolute precision, unless the context indicates otherwise. Instead, such terms allow for small variations. For example, electrodes that are described as being in a "parallel alignment" may not be exactly parallel, but may be parallel within an acceptable tolerance range (e.g., within approximately 5μ or within approximately 20μ). Likewise, a direction that is "orthogonal" to another direction may be orthogonal within an acceptable tolerance range.

Figure 4:
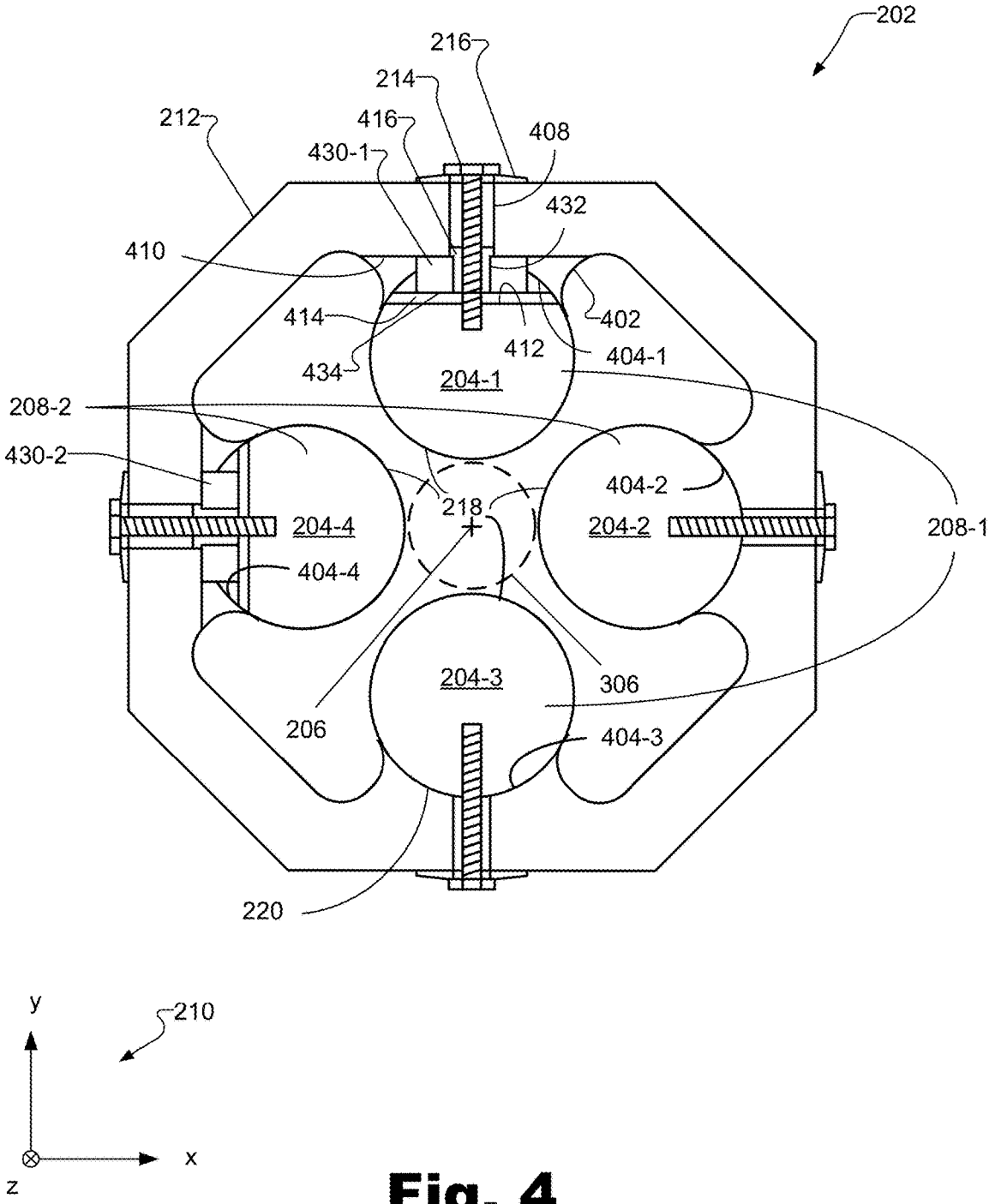

FIG. 4 shows a cross-sectional view of quadrupole 202 taken along the IV-IV line shown in FIG. 3. 3D coordinate system 210 is shown relative to quadrupole 202 in FIG. 4. As shown, support member 212 may generally have a ring structure (e.g., a circle, rectangle, square, octagon, or any other shape). Support member 212 may be formed of a rigid dielectric material, such as glass, ceramic, aluminum oxide, silicon dioxide (e.g., quartz, fused silica, etc.), and the like. An inside surface 402 of support member 212 may include a plurality of grooves 404 (e.g., first groove 404-1, second groove 404-2, third groove 404-3, and fourth groove 404-4) configured to maintain the position of electrodes 204. A shape of grooves 404 may substantially match a shape of a backside surfaces 220 of electrodes 204 to further maintain the position of electrodes 204. Set screw 214 passes through screw hole 408 in support member 212 and attaches to electrode 204 (e.g., electrode 204-1) so that electrode 204 is securely held by support member 212. Washer 216 is positioned between set screw 214 and support member 212.

Machining, assembling, and aligning electrodes 204 and support members 212 with small tolerances necessary for accurate operation of quadrupole 202 and high resolution of the produced mass spectrum can be difficult and expensive. Additionally, slight imperfections in support member 212 can cause the support member 212 to flex or bend when electrodes 204 are secured to the support member 212. The tension on a set screw 214 can be adjusted to compensate for such movement of electrodes 204, but adjusting the tension of a set screw 214 may adjust the positioning of the other electrodes 204 in quadrupole 202, thereby changing the alignment of electrodes 204 and, hence, the resolution of the produced mass spectrum. Furthermore, electrodes 204 and support members 212 may undergo thermal expansion with changes in temperature during operation, thereby further changing the alignment of electrodes 204.

To address these issues, quadrupole 202 includes one or more piezoelectric actuators 430 configured to adjust a position of one or more electrodes 204. As shown in FIG. 4, a first piezoelectric actuator 430-1 may be positioned between first electrode 204-1 and inside surface 402 of support member 212. For example, a notch or recess 410 with a flat surface may be formed in inside surface 402 of support member 212, and a notch or recess 412 with a flat surface may be formed in first electrode 204-2. First piezoelectric actuator 430-1 may be positioned inside recess 410 and recess 412. An insulator 414 may be positioned between first piezoelectric actuator 430-1 and first electrode 204-1 to electrically isolate first piezoelectric actuator 430-1 from the high RF and/or DC voltages applied to first electrode 204-1. Insulator 414 may include, but is not limited to, glass, ceramic, aluminum oxide, silicon dioxide (e.g., quartz, fused silica, etc.), and the like.

First piezoelectric actuator 430-1 may be any type or form of piezoelectric transducer, including but not limited to a plate, disc, ring, block, stack, stack ring, shear stack, unimorph, bimorph, and the like. In the embodiment shown in FIG. 4, first piezoelectric actuator 430-1 is a ring actuator having a hole 432 in the center portion. Hole 432 may be aligned with screw hole 408 in support member 212 such that set screw 214 also passes through hole 432. In this way, first piezoelectric actuator 430-1 may be securely held between support member 212 and first electrode 204-1. A shoulder washer 416 may be positioned in hole 432 between first piezoelectric actuator 430-1 and set screw 214 to electrically isolate first piezoelectric actuator 430-1 from set screw 214 (which is electrically connected to electrode 204).

In additional or alternative embodiments, first piezoelectric actuator 430-1 may be bonded to first electrode 204-1, support member 212, and/or insulator 414 by an adhesive, such as an epoxy or resin. In some embodiments, the adhesive may be a dielectric material that forms insulator 414.

First piezoelectric actuator 430-1 may include electrical leads (not shown) electrically connected to the DC power supply, which is configured to supply a DC control voltage to first piezoelectric actuator 430-1. First piezoelectric actuator 430-1 may be configured to adjust the position of first electrode 204-1 relative to a position of any one of the other electrodes 204 in any direction or combination of directions upon application of the DC control voltage to first piezoelectric actuator 430-1. In some embodiments, first piezoelectric actuator 430-1 may be configured to apply a force in a direction orthogonal to a contact surface 434 of first piezoelectric first actuator 430-1 (i.e., a surface that is in contact with first electrode 204 or insulator 414). For example, first piezoelectric actuator 430-1 may be configured to adjust a position of first electrode 204-1 in the y-direction, such as by pushing first-electrode toward third electrode 204-3.

In additional or alternative embodiments, first piezoelectric actuator 430-1 may be configured to apply a shear force in a direction parallel to the contact surface. For example, first piezoelectric actuator 430-1 may be a shear element configured to adjust a position of first electrode 204-1 in the x-direction or the z-direction. In some embodiments, first piezoelectric actuator may 430-1 may be a shear stack and configured to adjust a position of first electrode 204-1 in a combination of two or more of the x-direction, the y-direction, and the z-direction. Thus, a parallel alignment of first electrode 204-1 with respect to second electrode 204-2, third electrode 204-3, and/or fourth electrode 204-4 can be adjusted and improved by adjusting the position of first electrode 204-1.

Additionally, by using a shear stack configured to adjust a position of first electrode 204-1 in the z-direction, a longitudinal alignment of first electrode 204-1 (i.e., an alignment of first electrode 204-1 in the z-direction) can be adjusted and improved. In other words, end faces 304 of electrodes 204 (see FIG. 3) are aligned at the same longitudinal position (e.g., are in the same plane intersecting and orthogonal to the z-axis) such that the quadrupolar electric field encountered by an incoming ion beam (e.g., ion beam 110) is uniform and symmetric.

In like manner as first piezoelectric actuator 430-1, second piezoelectric actuator 430-2 may be positioned between fourth electrode 204-4 and inside surface 402 of support member 212 to enable adjustment of a position of fourth electrode 204-4. For example, second piezoelectric actuator 430-2 may be configured to adjust a position of fourth electrode 204-4 in the x-direction to adjust the parallel alignment of fourth electrode 204-4 with respect to second electrode 204-2. Additionally or alternatively, second piezoelectric actuator 430-2 may be configured to adjust a position of fourth electrode 204-4 in the y-direction to bring it into the same plane as second electrode 204-2, and may be configured to adjust a position of fourth electrode 204-4 in the z-direction to further adjust the longitudinal alignment of fourth electrode 204-4 with respect to the other electrodes 204.

In certain exemplary implementations, piezoelectric actuators 430 generally have a maximum displacement of approximately 0.1% of their thickness in the direction of displacement. For example, a piezoelectric stack 1 cm thick would offer a maximum displacement of approximately 10μ, while a piezoelectric actuator 3 mm thick would offer a maximum displacement of approximately 3μ. The amount of displacement also depends on the amount of the DC control voltage applied to the piezoelectric actuator. By varying the amount of the DC control voltage, piezoelectric actuators 430 may be configured to make fine adjustments of a position of an electrode 204 by as little as a few nanometers up to about 2μ, preferably by up to about 5μ, and more preferably by up to about 10μ.

In the embodiment just described, first piezoelectric actuator 430-1 and second piezoelectric actuator 430-2 enable adjustment of the positions of first electrode 204-1 and fourth electrode 204-4, respectively, in the x- and y-directions. Hence, a parallel alignment of both electrode pairs (e.g., first electrode pair 208-1 and second electrode pair 208-2) can be adjusted and improved.

In the foregoing embodiment, quadrupole 202 is shown with two piezoelectric actuators 430 positioned on different electrode pairs 208 on one support member 212 (see FIG. 4). However, quadrupole 202 is not limited to this configuration, and may be modified as may suit a particular implementation.

For example, quadrupole 202 is not limited to two piezoelectric actuators 430, but may have any number of piezoelectric actuators 430 positioned at any location as may suit a particular implementation. For example, quadrupole 202 may additionally include a piezoelectric actuator 430 for third electrode 204-3 and/or fourth electrode 204-4, or may include only one piezoelectric actuator (e.g., only first piezoelectric actuator 430-1). Additionally, quadrupole 202 may include a piezoelectric actuator 430 positioned at each end portion of quadrupole 202. For example, a piezoelectric actuator 430 may be positioned on first electrode 204-1 at the proximal end portion of quadrupole 202 (e.g., on first support member 212-1), and another piezoelectric actuator 430 may be positioned on first electrode 204-1 at the distal end portion of quadrupole 202 (e.g., on second support member 212-2) (see FIG. 3). In another example, support member 212 shown in FIG. 4 (having four electrodes 204) may be positioned at both end portions of quadrupole 202, e.g., first support member 212-1 and second support member 212-2 may have the configuration shown in FIG. 4. In additional embodiments, a piezoelectric actuator 430 may be disposed at a middle region along the z-direction of an electrode 204, e.g., between first support member 212-1 and second support member 212-2. For example, one or more piezoelectric actuators 430 may be located on electrodes 204 at or near a middle region (e.g., a position corresponding to center point 302). Actuation of such a piezoelectric actuator 430 may cause flexure or bending of the electrode 204 at the middle region between support members 212.

As shown in FIGS. 2-4, electrodes 204 are substantially circular such that the shape of facing surfaces 218 and the shape of backside surfaces 220 each form a segment of a circle. However, facing surfaces 218 and/or backside surfaces 220 can be any other suitable shape, including but not limited to hyperbolic (see, e.g., FIGS. 5 and 6), elliptical, and flat (e.g., a "flatapole") (see, e.g., FIGS. 5 and 6).

A saddle washer (not explicitly shown) may also be used to secure an electrode 204 to support member 212 and/or a piezoelectric actuator 430. In such embodiments, the electrode 204 may be secured to a concave surface side of the saddle washer, and the piezoelectric actuator 430 may be disposed between the opposing flat surface side of the saddle washer and support member 212. The saddle washer may be formed of a dielectric material, and/or a dielectric material may be disposed between the saddle washer and piezoelectric actuator 430 to electrically isolate the piezoelectric actuator 430 from the electrode 204. With this arrangement, it is not necessary to form a notch or recess (e.g., recess 410 and recess 412) in electrode 204 and/or support member 212.

Figure 5:
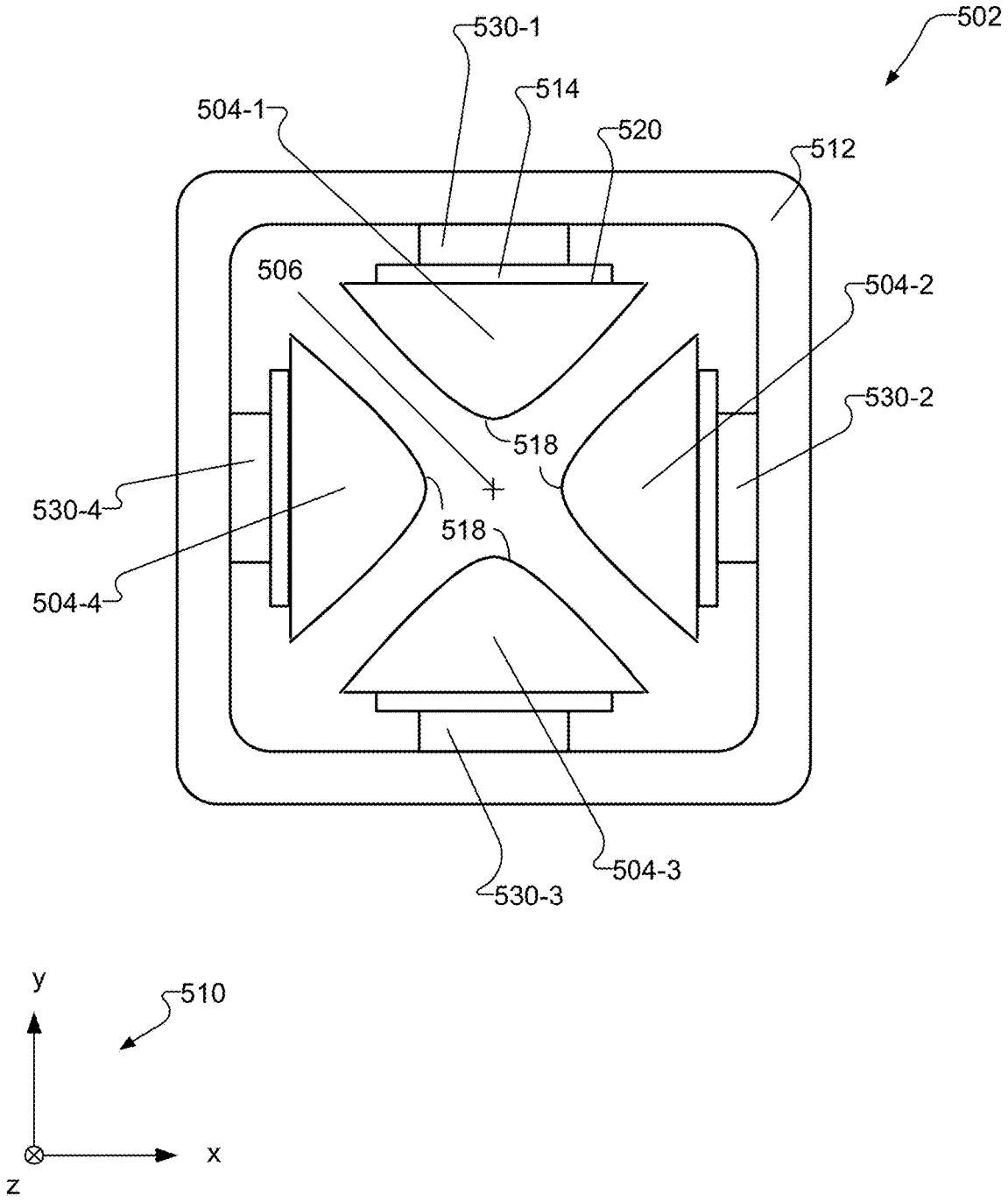
FIG. 5 illustrates another exemplary multipole assembly that may be included within the mass spectrometry system of FIG. 1 according to principles described herein.

FIG. 5 illustrates another exemplary multipole assembly that may be used in system 100. As shown in FIG. 5, the multipole assembly is a quadrupole 502 that includes four electrodes 504 (e.g., first electrode 504-1, second electrode 504-2, third electrode 504-3, and fourth electrode 504-4) arranged about an axis 506 extending along a longitudinal trajectory of electrodes 204. 3D coordinate system 510 is shown relative to quadrupole 502. Quadrupole 502 includes support member 512 to hold electrodes 504 in position. Facing surfaces 518 of electrodes 504 have a substantially hyperbolic shape, while backside surfaces 520 of electrodes 504 are flat.

Quadrupole 502 also includes a plurality of piezoelectric actuators 530 (e.g., first piezoelectric actuator 530-1, second piezoelectric actuator 530-2, third piezoelectric actuator 530-3, and fourth piezoelectric actuator 530-4) positioned between electrodes 504 and support member 512. An insulator 514 may be positioned between piezoelectric actuators 530 and electrodes 504. Piezoelectric actuators 530 may be bonded to electrodes 504, support member 512, and/or insulators 514 by an adhesive, such as an epoxy or resin. In some embodiments, the adhesive may be a dielectric material and forms insulator 514. Piezoelectric actuators 530 may be configured to adjust the position of one or more of electrodes 504 in the x-direction, y-direction, and/or z-direction, and thereby adjust a parallel alignment, longitudinal alignment, concentricity alignment, and/or angular alignment of electrodes 504 and/or quadrupole 502.

Figure 6:
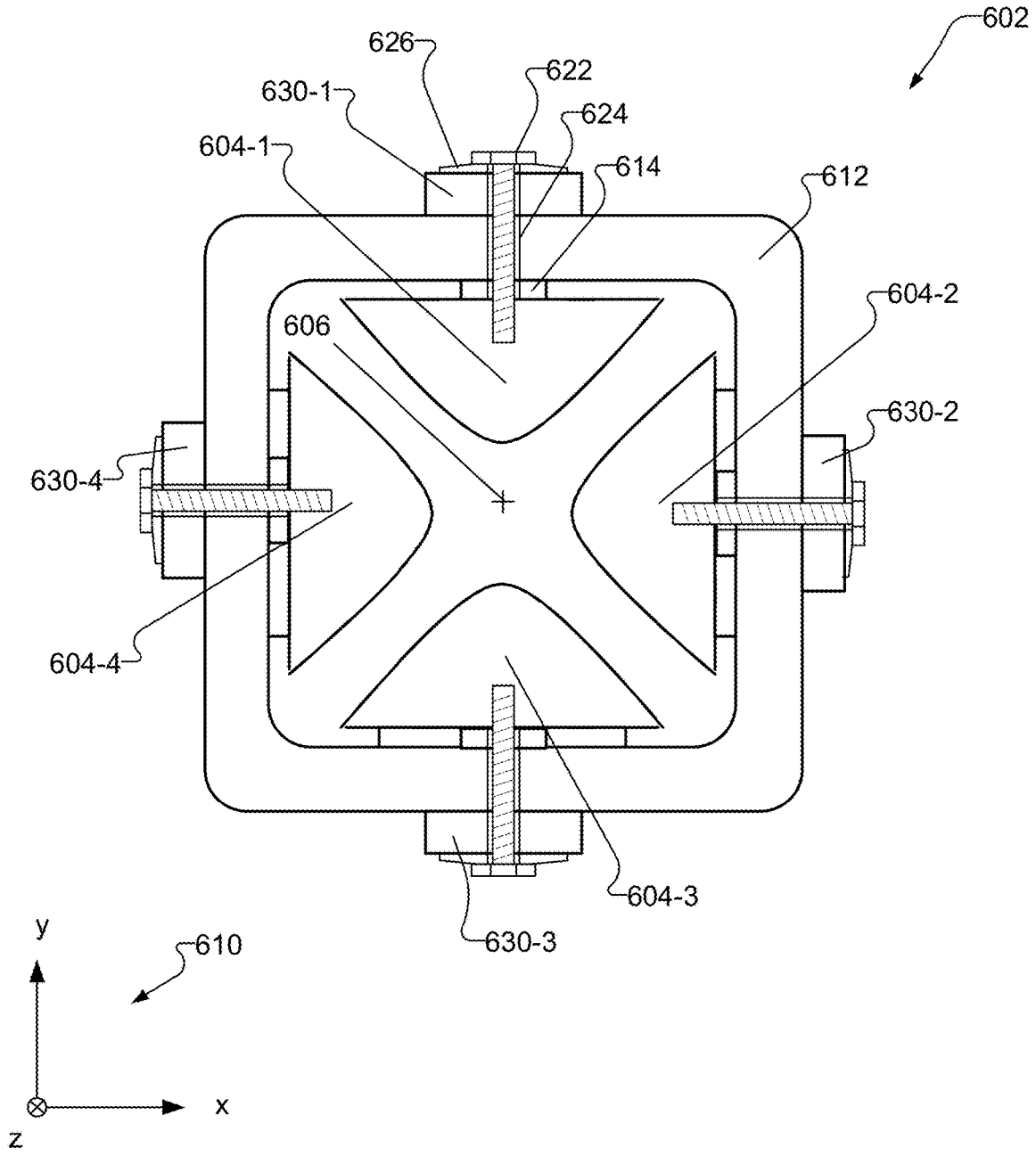
FIG. 6 illustrates another exemplary multipole assembly that may be included within the mass spectrometry system of FIG. 1 according to principles described herein.

FIG. 6 illustrates another exemplary multipole assembly that may be used in system 100. As shown, the multipole assembly is a quadrupole 602 that includes four electrodes 604 (e.g., first electrode 604-1, second electrode 604-2, third electrode 604-3, and fourth electrode 604-4) arranged about an axis 606 extending along a longitudinal trajectory of electrodes 604. 3D coordinate system 610 is shown relative to quadrupole 602. Quadrupole 602 includes support member 612 to hold electrodes 604 in position.

Quadrupole 602 also includes a plurality of piezoelectric actuators 630 (e.g., first piezoelectric actuator 630-1, second piezoelectric actuator 630-2, third piezoelectric actuator 630-3, and fourth piezoelectric actuator 630-4) positioned on the outside of support member 612, such that support member 612 is positioned between each electrode 604 and piezoelectric actuator 630. Piezoelectric actuators 630 and electrodes 604 may be held by support member 612 in any way described herein (e.g., by a fastener and/or an adhesive).

For example, set screw 622 may secure first piezoelectric actuator 630-1 to the outside of support member 612. Set screw 622 may be inserted in a screw hole 624 in support member 612 and attached to first electrode 604-1. Insulator 614 and/or a spring-type washer (not explicitly shown) may be positioned between first electrode 604-1 and support member 612. A spring-type washer 626 may be positioned between the head of set screw 622 and first piezoelectric actuator 630-1. First piezoelectric actuator 630-1 may be shielded from the RF voltage and/or mass resolving DC voltage applied to electrode 604 by an insulator that electrically isolates first piezoelectric actuator 630-1 from set screw 622, such as a shoulder washer (not shown). When first piezoelectric actuator 630-1 is actuated with a DC control voltage, it applies a force against set screw 622 on the outside of support member 612, which in turn adjusts the position of first electrode 604-1 on the inside of support member 612.

Additionally or alternatively, electrode 604 and first piezoelectric actuator 630-1 may be secured to support member 612 with an adhesive, such as with an epoxy or resin adhesive (not shown). Actuation of first piezoelectric actuator 630-1 may deform the adjoining portion of support member 612 and/or adjust a position of support member 612 (and hence all of electrodes 604) relative to an ion beam or an ion detector. With this configuration, first piezoelectric actuator 630-1 may be used to adjust a concentricity alignment and/or angular alignment of quadrupole 602 with an incoming ion beam or with an ion detector.

Second piezoelectric actuator 630-2, third piezoelectric actuator 630-3, and/or fourth piezoelectric actuator 630-4 may also be positioned on and secured to the outside of support member 612 in the same manner as first piezoelectric actuator 630-1. Accordingly, piezoelectric actuators 630 may be configured to adjust the position of one or more electrodes 604 in the x-direction, y-direction, and/or z-direction, and thereby adjust a parallel alignment, longitudinal alignment, concentricity alignment, and/or angular alignment of quadrupole 602 and/or electrodes 604.

In some embodiments, support member 612 may be formed of a conductive material, such as a metal or metal alloy, to shield piezoelectric device 630 from the RF quadrupolar field and/or DC electric field generated by electrodes 604. In the embodiment of FIG. 6, support member 612 may be electrically connected to a source of constant voltage, such as ground, to shield piezoelectric actuators 630 from the electric fields generated by electrodes 604. Piezoelectric actuators 630 may also be electrically isolated from support member 612 by one or more insulators (not explicitly shown). With this arrangement, the voltages applied to electrodes 604 and the resulting electric field can be prevented from affecting or influencing piezoelectric actuators 630.

Figure 7:
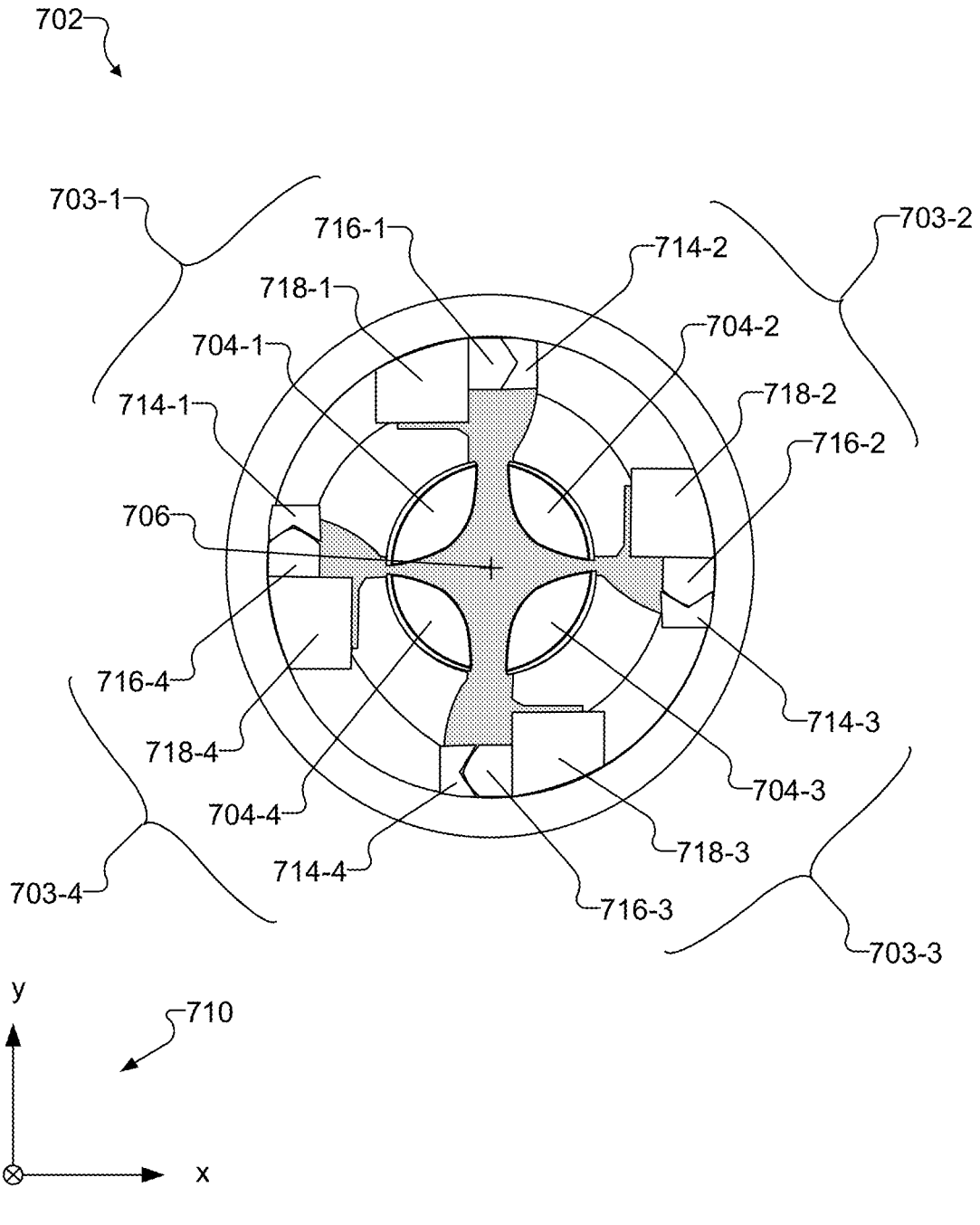
FIGS. 7-9 illustrate another exemplary multipole assembly that may be included within the mass spectrometry system of FIG. 1 according to principles described herein.
Figure 8:
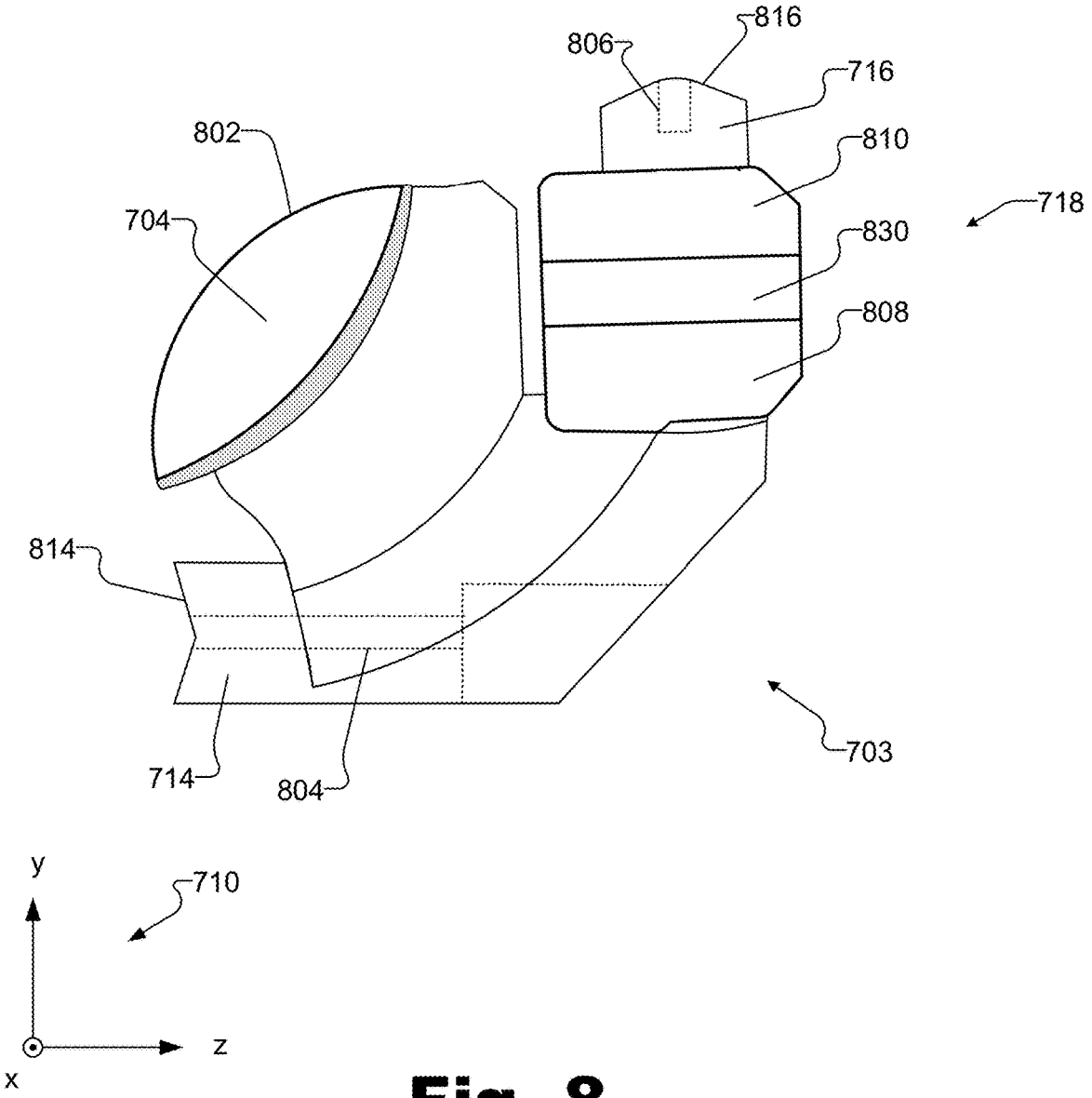
Figure 9:
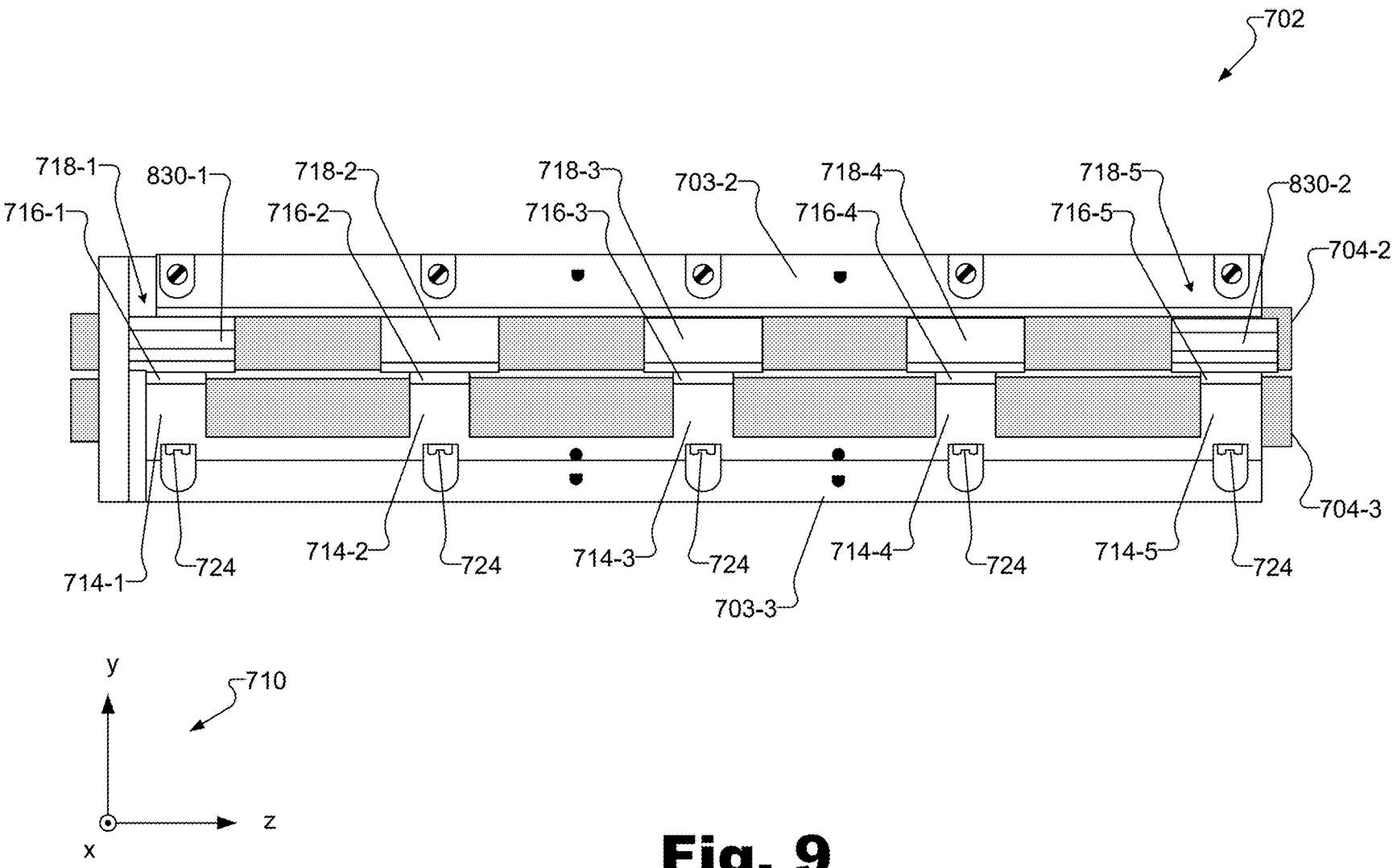

FIGS. 7-9 illustrate another exemplary multipole assembly that may be used in system 100. As shown in FIG. 7, the multipole assembly is a quadrupole 702 that has four identically formed electrode bodies 703 (e.g., first electrode body 703-1, second electrode body 703-2, third electrode body 703-3, and fourth electrode body 703-4), each of which includes an elongate electrode 704 (e.g., first electrode 704-1, second electrode 704-2, third electrode 704-3, and fourth electrode 704-4) formed at a central portion of the electrode body 703. Side portions of electrode bodies 703 rest on one another when electrodes 704 are arranged about an axis 706 extending along a longitudinal trajectory of electrodes 704. FIG. 7 shows 3D coordinate system 710 relative to quadrupole 702.

Electrode bodies 703 include, along a first side of electrode bodies 703, abutment members 714 (e.g., first abutment member 714-1, second abutment member 714-2, third abutment member 714-3, and fourth abutment member 714-4) projecting from electrode bodies 703 in a direction orthogonal to a longitudinal direction of electrode bodies 703. Electrode bodies 703 also include, along a second side of electrode bodies 703, bearing members 716 (e.g., first bearing member 716-1, second bearing member 716-2, third bearing member 716-3, and fourth bearing member 716-4) projecting from electrode bodies 703 in a direction orthogonal to the longitudinal direction of electrode bodies 703 and orthogonal to a projection direction of abutment members 714. Bearing members 716 are supported on electrode bodies 703 by bearing bodies 718 (e.g., first bearing body 718-1, second bearing body 718-2, third bearing body 718-3, and fourth bearing body 718-4). Bearing bodies 718 may include one or more layers formed of a dielectric material, such as glass, ceramic, aluminum oxide, silicon dioxide (e.g., quartz, fused silica, etc.), and the like, in order to electrically insulate bearing members 716 from electrodes 704 when an RF voltage and/or a mass resolving DC voltage is applied to electrodes 704.

FIG. 8 shows a cross-sectional view of an individual electrode body 703. As shown in FIG. 8, facing surface 802 of electrode 703 has a substantially hyperbolic cross-section. Abutment member 714 has an abutment surface 814, and bearing member 716 has a bearing surface 816. Abutment surface 814 is configured to abut against a bearing surface 816 of an adjacent electrode body 703 when all four electrode bodies 703 are arranged about axis 706 (as shown in FIG. 7). A shape of abutment surface 814 may be mated to a shape of bearing surface 816 to facilitate positioning of electrode bodies 703 and, hence, electrodes 704. For example, abutment surface 814 may be concave while bearing surface 816 may be convex, or vice versa. Abutment member 714 includes screw hole 804 for a set screw (not shown) to secure electrode body 703 to an adjacent electrode body on the first side of electrode body 703. Bearing member 716 includes screw hole 806 for another set screw (not shown) to secure electrode body 703 to another adjacent electrode body on the second side of electrode body 703.

Electrode 704 and abutment member 714, including abutment surface 814, may be formed integrally with one another. However, it can be difficult and expensive to machine electrode 704 and abutment member 714, including abutment surface 814, as well as bearing member 716 and bearing body 718, with the small tolerances necessary to produce a uniform electric field to obtain a high resolution mass spectrum, when electrode body 703 is used in quadrupole 702. Accordingly, quadrupole 702 includes one or more piezoelectric actuators configured to adjust a position of an electrode 704, and thereby adjust a parallel alignment, longitudinal alignment, concentricity alignment, and/or angular alignment of the electrode 704 and/or quadrupole 702.

For example, as shown in FIG. 8, bearing body 718 includes a piezoelectric actuator 830 positioned between a first insulation layer 808 and a second insulation layer 810. Piezoelectric actuator 830 may be secured to first insulation layer 808 and second insulation layer 810 by an adhesive, such as an epoxy or resin. Piezoelectric actuator 830 may be any type or form of piezoelectric actuator as described herein, and may be configured to adjust a position of electrode 704 in any direction (e.g., in the x-direction, y-direction, and/or z-direction).

FIG. 9 shows a side view of quadrupole 702 of FIG. 7. FIG. 9 shows 3D coordinate system 710 relative to quadrupole 702. As shown in FIG. 9, second electrode body 703-2 and third electrode body 703-3 rest on one another. Second electrode body 703-2 includes second electrode 704-2 and a plurality of bearing members 716 (e.g., bearing members 716-1 to 716-5) on a plurality of bearing bodies 718 (e.g., bearing bodies 718-1 to 718-5) positioned along the longitudinal length of second electrode body 703-2. Third electrode body 703-3 includes third electrode 704-3 and a plurality of abutment members 714 (e.g., abutment members 714-1 to 714-5) positioned along the longitudinal length of third electrode body 703-3. Bearing members 716 of second electrode body 703-2 abut against abutment members 714 of third electrode body 703-3. Second electrode body 703-2 and third electrode body 703-3 are held together by set screws 724 in abutment members 714 and bearing members 718. Although not shown in FIG. 9, first electrode body 703-1 and fourth electrode body 703-4 are also held together and to second electrode body 703-2 and third electrode body 703-3 in a similar manner, thus forming quadrupole 702.

As shown in FIG. 9, second electrode body 703-2 includes a first piezoelectric actuator 830-1 on bearing body 718-1, and a second piezoelectric actuator 830-2 on bearing body 718-5. Piezoelectric actuators 830 are configured to adjust a position of second electrode body 703-2 in the x-direction, y-direction, and/or z-direction. In this way, a parallel alignment and/or a longitudinal alignment of second electrode 704-2 can be adjusted. Additionally, a concentricity alignment and/or an angular alignment of quadrupole 702 can be adjusted. In additional or alternative implementations, any one or more other bearing bodies 718 may also include a piezoelectric actuator. Additionally, any one or more of second electrode body 703-2, third electrode body 703-3, and fourth electrode body 703-4 may include one or more piezoelectric actuators, as may suit a particular implementation.

The exemplary multipole assemblies described above with reference to FIGS. 2-9 are quadrupolar in arrangement. However, the multipole assembly used in system 100 is not limited to this configuration. In additional or alternative embodiments, the multipole assembly used in system 100 may have any number of electrodes, and may include, but is not limited to, a hexapole, an octapole, a decapole, a dodecapole, etc.

Figure 10:
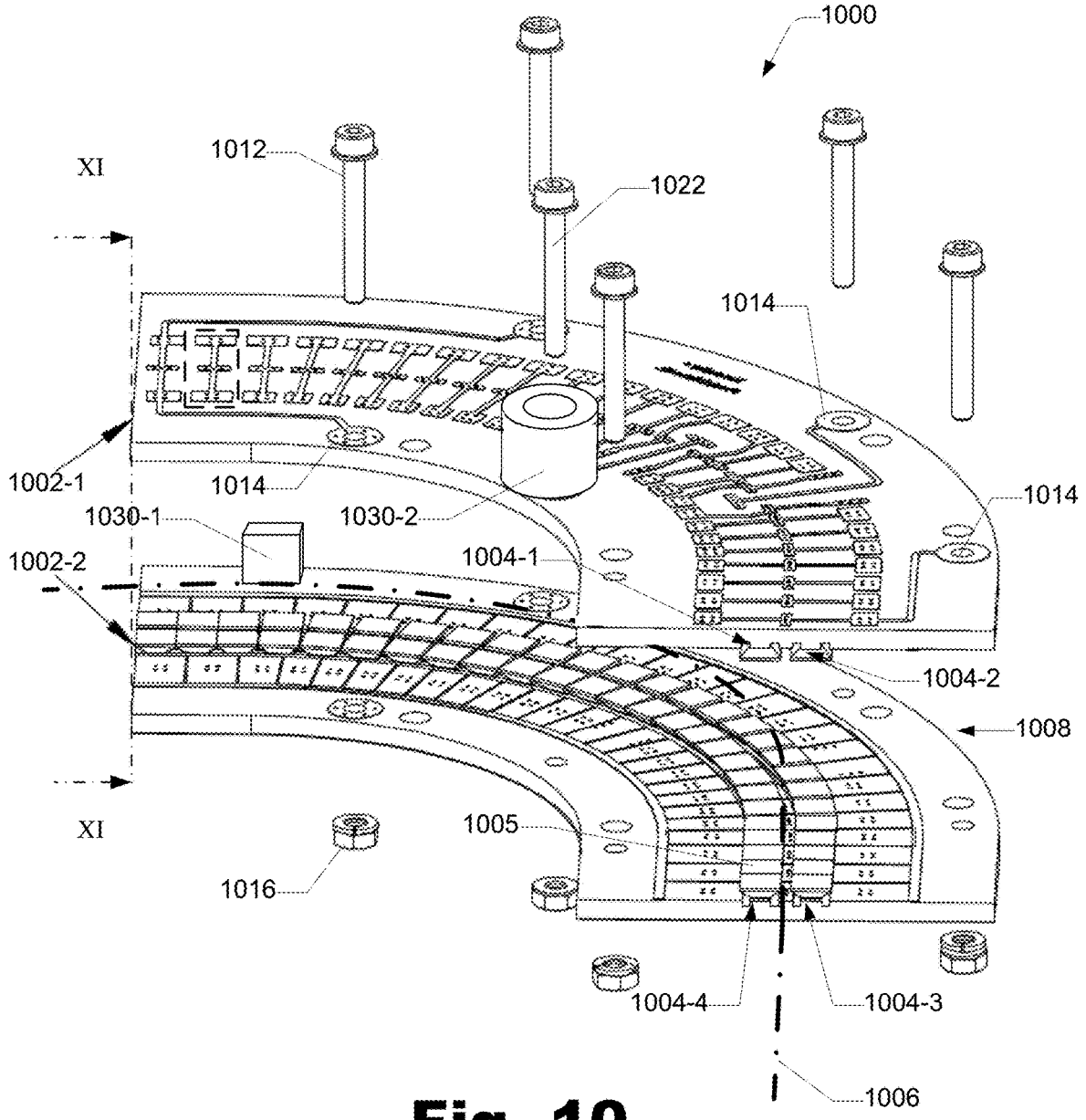
FIGS. 10-11 illustrate another exemplary multipole assembly that may be included within the mass spectrometry system of FIG. 1 according to principles described herein.
Figure 11:
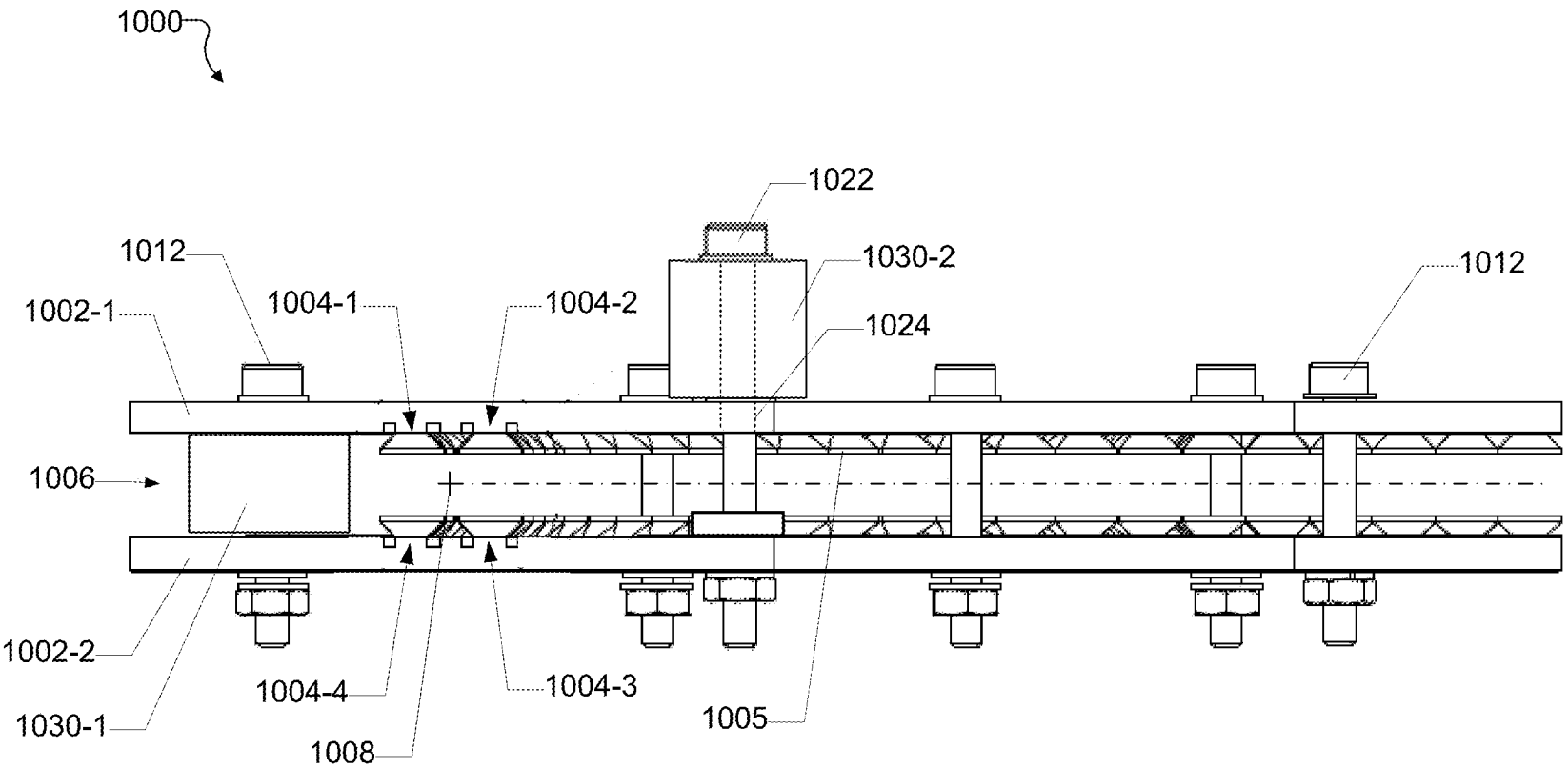

FIG. 10 shows an exploded perspective view of another exemplary multipole assembly 1000 that may be used in system 100, and FIG. 11 shows a cross-sectional view of multipole assembly 1000 taken along the XI-XI line. In this embodiment, multipole assembly 1000 may be a planar multipole assembly, such as an ion guide formed on a pair of printed circuit boards (PCBs) with their printed surfaces parallel to and facing each other.

Multipole assembly 1000 includes first PCB 1002-1 and second PCB 1002-2 positioned opposite one another with a gap 1008 in between. PCBs 1002 can be formed of PCB material, ceramic, glass, or the like. A plurality of electrodes 1004 (e.g., first electrode 1004-1 and second electrode 1004-2) may be formed (e.g., deposited, screwed on, printed, etc.) on first PCB 1002-1, and another plurality of electrodes 1004 (e.g., third electrode 1004-3 and fourth electrode 1004-4) may be formed on second PCB 1002-2. Electrodes 1004 may be segmented or continuous, and may be in any shape, including a straight line, an arc, a curve, a sigmoidal curve, or any combination thereof or other suitable configuration.

Electrodes 1004 are arranged about an axis 1006 (see FIG. 11) extending along a longitudinal trajectory of electrodes 1004. In the embodiment shown in FIG. 10, the longitudinal trajectory of electrodes 1004 is a 90° curve. Electrodes 1004 extend parallel to one another along the longitudinal trajectory of electrodes 1004. Facing surfaces 1005 of electrodes 1004 (i.e., surfaces of electrodes 1004 that face an opposite electrode 1004 on the opposite PCB 1002) may be flat. Electrodes 1004 are arranged as opposing electrode pairs across axis 1006. For example, a first electrode pair may include first electrode 1004-1 positioned opposite to third electrode 1004-3, and a second electrode pair may include second electrode 1004-2 positioned opposite to fourth electrode 1004-4. RF voltages, and optionally mass resolving DC voltages, may be applied to each electrode pair, with the voltages applied to electrode pairs having an opposite phase or polarity, thereby generating an electric field configured to confine ions radially about axis 1006 along the longitudinal trajectory of electrodes 1004.

PCBs 1002 may be aligned with one another and held in place to maintain alignment of electrodes 1004. For example, PCBs 1002 may be aligned and held in place by mounting bolts 1012 (inserted through mounting holes 1014) and nuts 1016. Alternatively, PCBs 1002 may be aligned and held in place by sheet metal, spacers, adhesives, or any other suitable means. With the above-described configuration, multipole assembly 1000 may function as an ion guide, a quadrupole mass filter, a collision cell, or an ion trap.

However, PCBs 1002 sometimes bow, flex, or warp, thus causing asymmetries in the electric field generated by electrodes 1004, which can impede the transmission of desirable ions through multipole assembly 1000. Accordingly, multipole assembly 1000 may include one or more piezoelectric actuators 1030 configured to adjust a position of an electrode 1004 with respect to another electrode 1004. This may be accomplished, for example, by adjusting a position of a PCB 1002 at a location near a bow or other deformity in PCB 1002.

For example, multipole assembly 1000 may include first piezoelectric actuator 1030-1 positioned in gap 1008 such that it is configured to push a PCB 1002 (e.g., first PCB 1002-1) away from the other PCB 1002 (e.g., second PCB 1002-2). Piezoelectric actuator 1030-1 may be positioned at a location near electrodes 1004 to target any bows occurring near electrodes 1004.

Multipole assembly 1000 may additionally or alternatively include a piezoelectric actuator positioned on the outside of multipole assembly 1000 (e.g., on a side of PCB 1002 opposite to a side facing gap 1008). For example, second piezoelectric actuator 1030-2 may be mounted on an outside surface of first PCB 1002-1 and engage with a proximal end of adjustment rod 1022 (e.g., a mounting bolt 1012). Adjustment rod 1022 may be inserted in through hole 1024 in first PCB 1002-1 so that adjustment rod 1022 can move independently of first PCB 1002-1 upon actuation of second piezoelectric actuator 1030-2.

By actuation of second piezoelectric actuator 1030-2, adjustment rod 1022 can be moved up or down. The distal end of adjustment rod 1022 may engage with second PCB 1002-2 to push and/or pull second PCB 1002-2. For example, the distal end of adjustment rod 1022 may be configured to push second PCB 1002-2 away from first PCB 1002-1 by pressing against an inside surface of first PCB 1002-1, such as with a flange, an end face of adjustment rod 1022, or a nut and washer secured to adjustment rod 1022 inside gap 1008. Additionally or alternatively, the distal end of adjustment rod 1022 may be configured to pull second PCB 1002-2 toward first PCB 1002-1 by pulling on an outside surface of second PCB 1002-2, such as with nut 1016 and a washer secured to adjustment rod 1022 on the outside surface of second PCB 1002-2. Thus, by actuation of second piezoelectric actuator 1030-2, a bow in second PCB 1002-2 can be pushed or pulled as necessary to adjust a parallel alignment of second PCB 1002-2 with first PCB 1002-1. In this way, second piezoelectric actuator 1030-2 can adjust a position of third electrode 1004-3 and fourth electrode 1004-4 on second PCB 1002-2. In like manner, a piezoelectric actuator may also be positioned on the outside of second PCB 1002-2 in order to adjust a position of first PCB 1002-1, and hence first electrode 1004-1 and second electrode 1004-2.

In some embodiments, the piezoelectric actuator may be a piezoelectric bimorph actuator configured to adjust a position of first PCB 1002-1 and/or second PCB 1002-2. For example, piezoelectric actuator 1030-2 of FIG. 11 may be a piezoelectric bimorph actuator mounted on the outside surface of first PCB 1002-1 near a spacer or mounting bolts (e.g., mounting bolts 1012) to provide a fixed location from where piezoelectric actuator 1030-2 can directly lift or push the PCB 1002 where it is mounted (e.g., first PCB 1002-1), and/or indirectly lift or push the opposite PCB 1002 (e.g., second PCB 1002-2), such as by way of adjustment rod 1022.

Multipole assembly 1000 may include any number and type of piezoelectric actuators positioned on either or both PCBs 1002, as may suit a particular implementation. Moreover, in some examples, in order to compensate for large asymmetries and defects in the electric field generated by electrodes 1004, piezoelectric actuators 1030 may be configured to adjust a position of PCBs 1002 by up to about 5μ, preferably by up to about 10μ, and more preferably by up to about 20μ.

A multipole assembly as described in the above exemplary embodiments enables calibration and adjustment of the alignment of the multipole assembly and/or individual electrodes of the multipole assembly before and/or during operation of system 100.

For example, to calibrate the multipole assembly, the multipole assembly may be gauged after manufacture to determine an alignment of electrodes included in the multipole assembly. Any suitable means of gauging the electrodes may be used. In one example, gauging may be performed by using an air gauge that uses a puck that floats between the electrodes and measures the back pressure of air leaking across the puck. Based on the results of the gauging, a DC control voltage can be supplied to one or more piezoelectric actuators to adjust positions of one or more electrodes until a desired preset alignment of the multipole assembly is obtained. The values of the DC control voltages (referred to as "calibration values") supplied to the piezoelectric actuators to bring the electrodes into the preset alignment can then be recorded and stored, such as in a storage device or memory of controller 108. When system 100 is operated to perform a mass analysis, controller 108 may access the recorded calibration values of the DC control voltages to control the DC power supply to supply the DC control voltages to the electrodes in order to bring the multipole assembly into the preset alignment. With this calibration, the preset alignment of the multipole assembly can be obtained, even after manufacture and assembly of a mass spectrometry system in which the multipole assembly is used.

In some circumstances, however, a calibrated multipole assembly may not perform optimally during a mass analysis. This may be due, for example, to environmental changes (e.g., temperature changes causing thermal expansion of the electrodes) or mechanical changes (e.g., shifting of electrodes during transport, or adjustment of the concentricity alignment or angular alignment with ion beam 110, etc.). For example, although electrodes in a multipole assembly may be formed of a material having a low coefficient of thermal expansion, an increase in an ambient temperature near the electrodes may still cause thermal expansion of the electrodes and thus affect their alignment. To address such issues, system 100 (e.g., controller 108) may include a feedback control system configured to control a multipole assembly to adjust the position of one or more electrodes, or the entire multipole assembly, in response to a detection of a change in an operating condition of mass spectrometry system 100.

Figure 12:
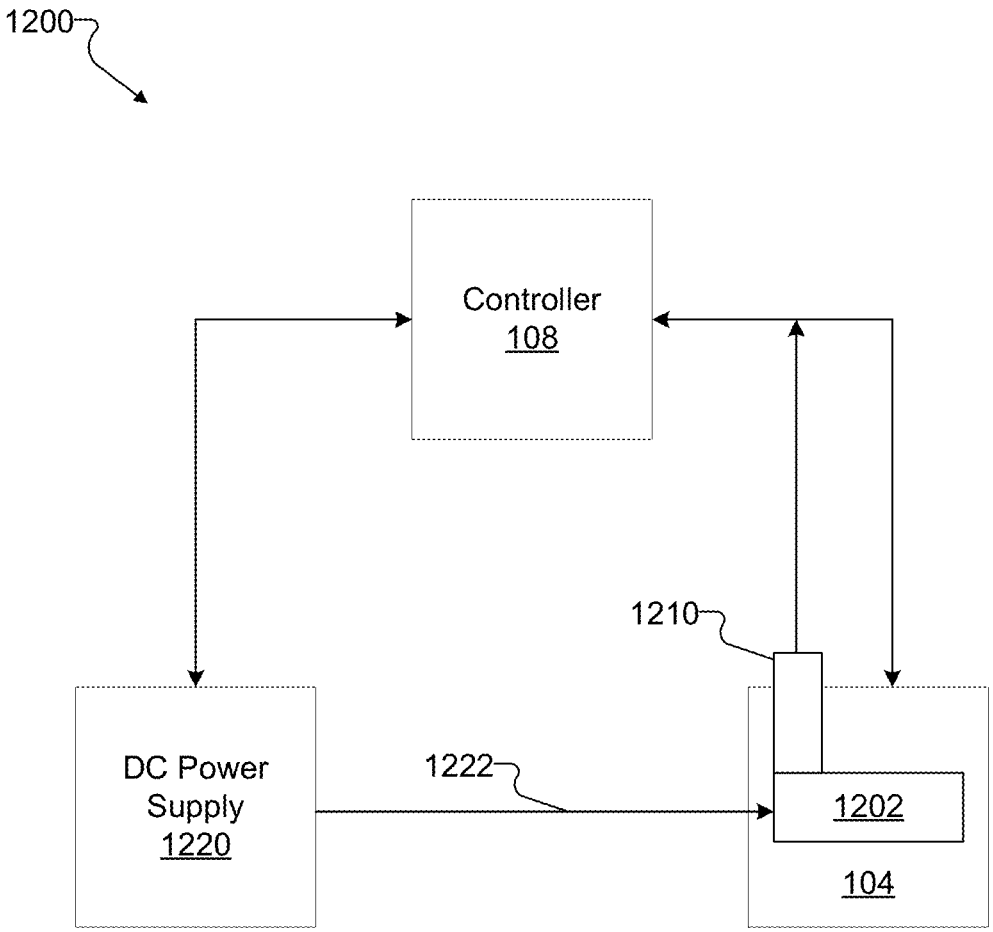
FIG. 12 illustrates an exemplary feedback control system that may be implemented within the mass spectrometry system of FIG. 1 according to principles described herein.

FIG. 12 shows a feedback control system 1200 that may include one or more sensors 1210 configured to detect an operating condition of system 100. Sensors 1210 may be any type of sensor configured to detect an operating condition of system 100 (e.g., temperature, pressure, moisture content, resistance, current, voltage, position, and the like). Sensors 1210 may be positioned at any suitable location in system 100 (e.g., in ion source 102, mass analyzer 104, and/or ion detector 106) and are communicatively coupled with controller 108. As an example, mass analyzer 104 may include a temperature sensor 1210 configured to detect an ambient temperature near a multipole assembly 1202 implemented by mass analyzer 104. Controller 108 may receive and collect temperature data representative of the detected temperature from temperature sensor 1210. Controller 108 may use the temperature data to detect when a change in temperature occurs. When a change in temperature is detected, or when the change in temperature exceeds a predetermined threshold amount, controller 108 may control DC power supply 1220 to supply a compensating DC control voltage 1222 to one or more piezoelectric actuators included in multipole assembly 1202 to adjust a position of one or more electrodes included in multipole assembly 1202.

In some embodiments, the amount of the compensating DC control voltage 1222 to be applied to the piezoelectric actuators may be obtained from a lookup table (LUT) that correlates a given temperature change with an appropriate compensating DC control voltage to be applied to each piezoelectric actuator. The LUT may be generated experimentally, such as by performing a mass analysis of a known sample with system 100 under controlled conditions. The compensating DC control voltage may be determined based on analysis of the mass positions and the peak widths on the resulting mass spectrum. For example, during the mass analysis the ambient temperature of system 100, as detected by temperature sensor 1210, can be changed by a known amount, and the DC control voltage 1222 applied to one or more piezoelectric actuators can be iteratively adjusted until the mass positions and peak widths on the mass spectrum show the optimal resolution and/or match the mass positions and peak widths on the mass spectrum prior to the change in temperature. This analysis can be done manually by a user and/or automatically by system 100. The LUT may then be updated with data representative of the compensating DC control voltage for the specific value of detected temperature change. The LUT may be based on and specific to a particular multipole assembly and/or system 100, or the LUT may be generic and applicable to multipole assemblies of a particular type included in different mass spectrometry systems.

In other embodiments, the compensating DC control voltage 1222 may be iteratively determined, whether manually or automatically, in real time during operation of system 100 in response to the detection of the change in temperature.

As another example of the feedback control system 1200 of system 100, mass analyzer 104 may include a sensor 1210 in the form of a force transducer configured to detect a position of an electrode included in multipole assembly 1202. The force transducer may be, for example, a strain gauge or a piezoelectric transducer. In some embodiments, the force transducer may be built-in or part of a piezoelectric actuator configured to adjust a position of an electrode (e.g., piezoelectric actuator 430). Controller 108 may periodically or continuously receive and collect force data (e.g., a voltage level) indicative of a force applied to the force transducer by an electrode in multipole assembly 1202. Controller 108 may analyze the force data to determine when a change in alignment of multipole assembly 1202 and/or electrodes included in multipole assembly 1202 occurs. When a change in alignment is detected, controller 108 may control DC power supply 1220 to supply a compensating DC control voltage 1222 to one or more piezoelectric actuators included in multipole assembly 1202 to adjust a position of multipole assembly 1202 and/or one or more electrodes included in multipole assembly 1202.

A change in alignment may be detected, for example, when controller 108 determines that the force data varies from a predetermined baseline value (or range of values) of force data. The predetermined baseline value may be indicative of an alignment state of multipole assembly 1202 or the electrodes included in multipole assembly 1202. The predetermined baseline value may be determined experimentally by performing a mass analysis of a known sample and analyzing the mass spectrum to determine the mass positions and peak widths. When the desired resolution of the mass spectrum is obtained, the force value indicated by the force transducer may be recorded and stored (e.g., in a storage device or memory of controller 108) as the predetermined baseline value. Alternatively, the predetermined baseline value may be determined based on a gauging and/or calibration of the multipole assembly, as described above, to obtain the preset alignment.

The compensating DC control voltage 1222 to be applied to a piezoelectric actuator in multipole assembly 1202 in response to a detection of a change in alignment may be determined from a lookup table (LUT) that correlates force values with the appropriate compensating DC control voltages. The LUT may be generated similar to the method for generating a temperature change LUT described above. Alternatively, the compensating DC control voltage 1222 may be iteratively determined, whether manually or automatically, in real time in response to the detection of the change in alignment.

With the calibration and feedback control described above, system 100 may adjust the alignment of multipole assembly (e.g., the concentricity alignment with ion beam 110 or ion detector 106, the angular alignment with ion beam 110 or ion detector 106, the longitudinal alignment of the electrodes, and/or the parallel alignment of the electrodes) and maintain the alignment during operation of system 100 (e.g., during a mass analysis).

During operation of system 100, controller 108 controls the oscillatory voltage power supply to supply opposite phases of an RF voltage to the pairs of electrodes included in the multipole assembly to guide or trap ions within the multipole assembly. When the multipole assembly functions as a mass filter, controller 108 also controls the DC power supply to supply a mass resolving DC voltage to the pairs of rod electrodes to selectively filter out for detection ions having an effective range of ratios of mass to charge. During this mass analysis, system 100 may scan a range of ratios of mass to charge by varying, over time, the RF voltages and mass resolving DC voltages supplied to the electrodes.

As mentioned above, the feedback control system of system 100 may adjust a position of one or more electrodes during operation of system (e.g., during a scan) in response to a detected change in operating conditions. Additionally, controller 108 may be configured to dynamically adjust the position of an electrode during a scan of a range of ratios of mass to charge. For example, for each range of ratio of mass to charge analyzed, a position of the electrode may be dynamically adjusted across a range of positions by varying the DC control voltage supplied to a piezoelectric actuator configured to adjust the position of the electrode. When the next range of ratio of mass to charge is analyzed in the scan, the position of the electrode is again adjusted across the range of positions. In this way, poor resolution in the mass spectrum can be compensated during the scan.

In some embodiments, in order to enable the piezoelectric actuator to sample a range of positions during the scan, an axial preload is applied to the piezoelectric actuator. Applying an axial preload allows the piezoelectric actuator to apply a maximum displacement while sampling at a rate fast enough for the scan (e.g., 1000 Hz or more) without failure. The axial preload may be applied by any suitable means, such as by positioning a spring or spring-type mechanism (e.g., a spring-type washer) between the piezoelectric actuator and one or more of the support member, electrode, and fastener (see, e.g., FIG. 6).

Various methods operating and making the multipole assembly will now be described.

Figure 13:
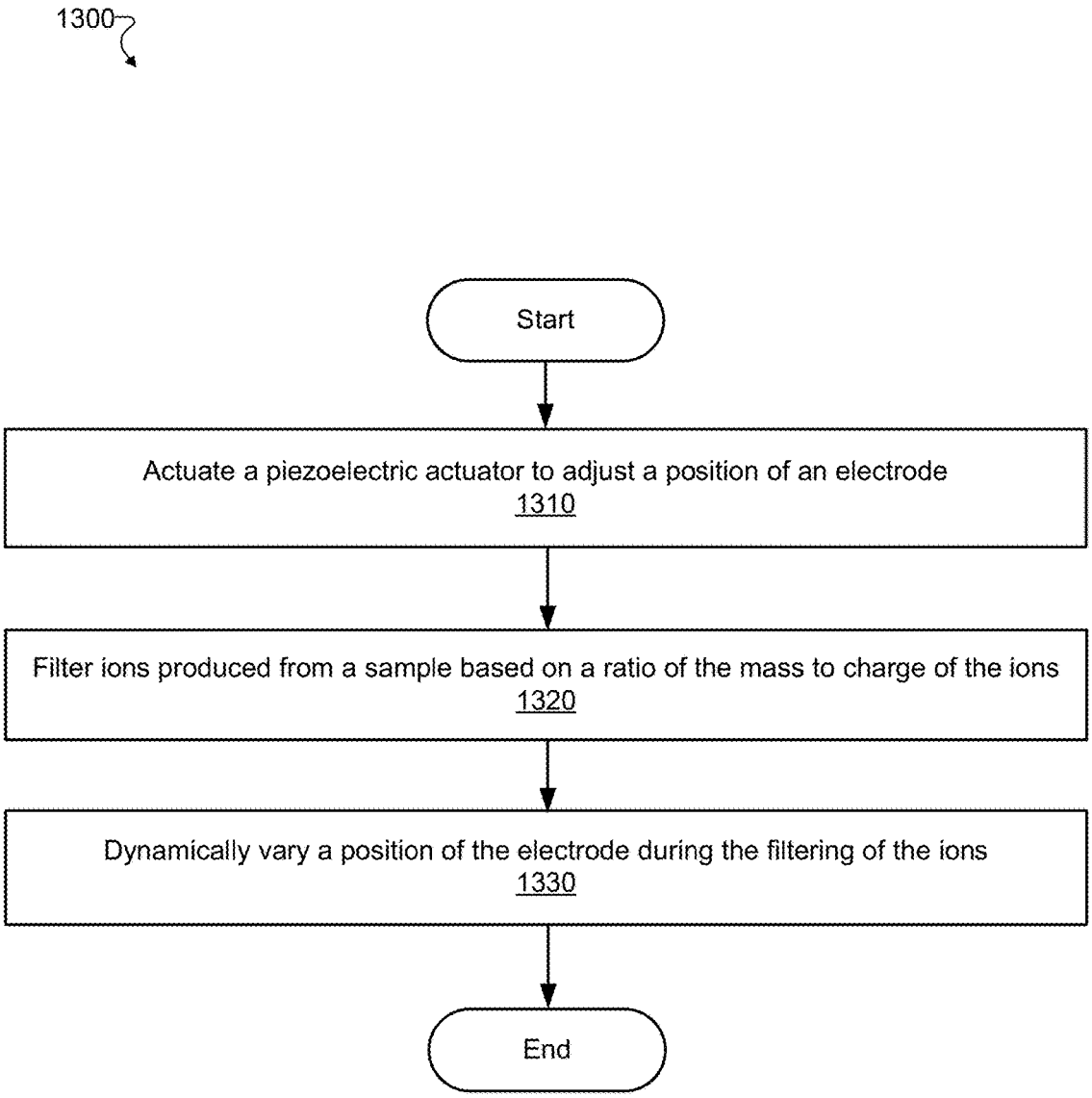
FIGS. 13-14 illustrate exemplary methods of operating a mass spectrometry system according to principles described herein.

FIG. 13 shows an exemplary method of operating a mass spectrometer having a multipole assembly comprising a plurality of elongate electrodes arranged about an axis extending along a longitudinal trajectory of the plurality of elongate electrodes and configured to confine ions radially about the axis, and a piezoelectric actuator configured to adjust a position of a first electrode included in the plurality of elongate electrodes. While FIG. 13 identifies exemplary steps according to one embodiment, other embodiments may omit, add to, reorder, combine, and/or modify any of the steps shown in FIG. 13.

In step 1310, the piezoelectric actuator is actuated to adjust a position of an electrode included in the plurality of elongate electrodes. This may be performed in any of the ways described herein, such as by applying a DC control voltage to the piezoelectric actuator to adjust the position of the electrode. The position of the electrode may be adjusted in any direction(s) as described herein.

In step 1320, ions produced from a sample are filtered based on a ratio of the mass to charge of the ions. This may be done in any of the ways described herein, such as by applying a range of RF voltages and mass resolving DC voltages over time to the plurality of electrodes during a scan of a range of ratios of mass to charge. In some embodiments, the actuation of the piezoelectric actuator to adjust the position of the electrode may be performed during the scan of the range of ratios of mass to charge.

In step 1330, the position of the electrode is dynamically varied during the filtering of the ions. This may be performed in any manner described herein, such as by dynamically varying the DC control voltage applied to the piezoelectric actuator during the scan.

Figure 14:
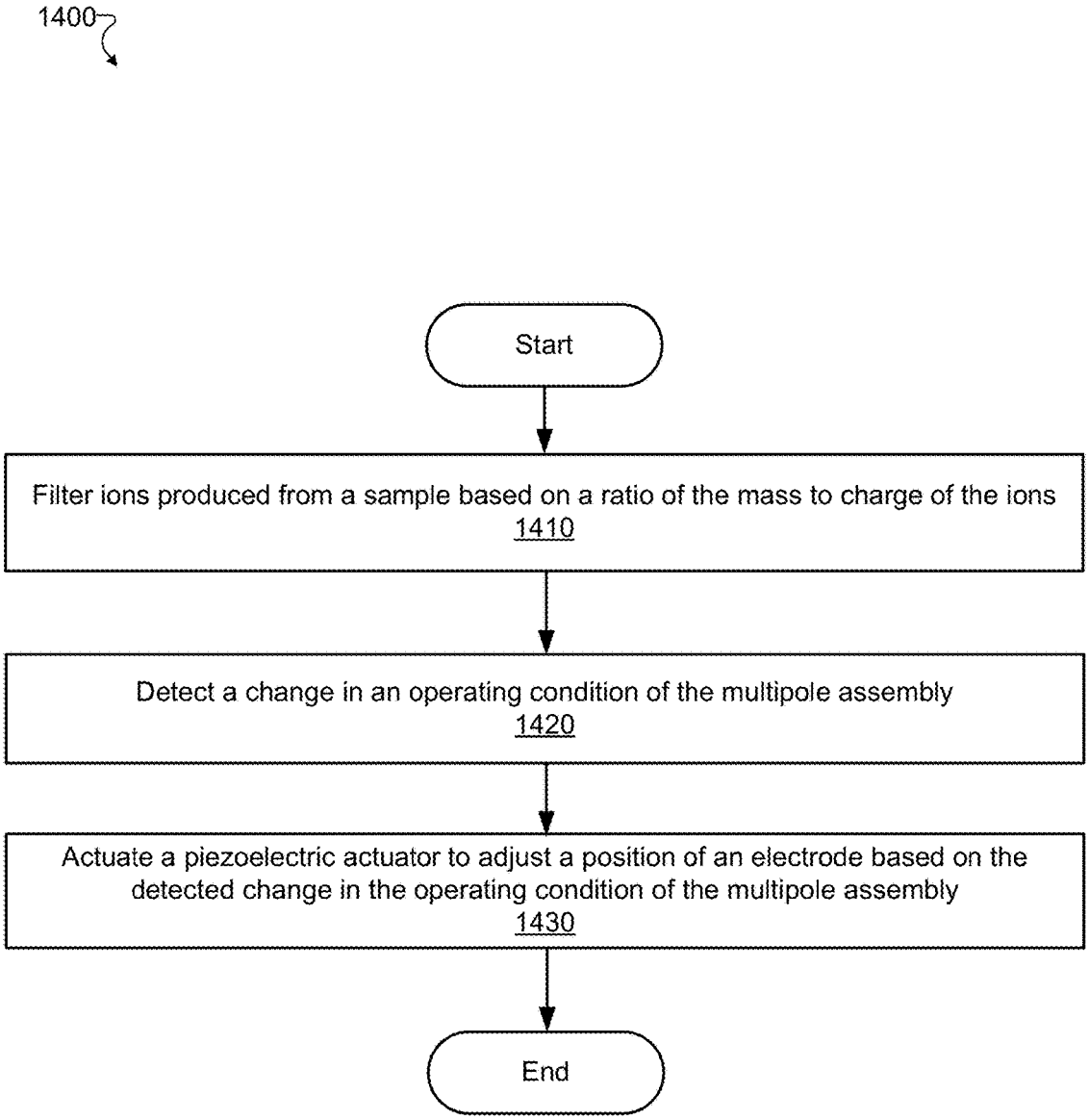

FIG. 14 shows another exemplary method of operating a mass spectrometer having a multipole assembly comprising a plurality of elongate electrodes arranged about an axis extending along a longitudinal trajectory of the plurality of elongate electrodes and configured to confine ions radially about the axis, and a piezoelectric actuator configured to adjust a position of a first electrode included in the plurality of elongate electrodes. While FIG. 14 identifies exemplary steps according to one embodiment, other embodiments may omit, add to, reorder, combine, and/or modify any of the steps shown in FIG. 14.

In step 1410, ions produced from a sample are filtered based on a ratio of the mass to charge of the ions. This can be performed in any manner described herein, such as by applying a range of RF voltages and mass resolving DC voltages over time to the plurality of electrodes during a scan of a range of ratios of mass to charge.

In step 1420, a change in an operating condition of the multipole assembly is detected. The change in the operating condition can be detected in any manner described herein, such as by detecting a change in a temperature of the multipole assembly or detecting a change in a position of an electrode. In other implementations, the monitored operating condition may be a mass spectrometer performance metric (e.g., sensitivity, resolution, or mass accuracy) that is influenced by the alignment and positioning of the electrodes of the multipole assembly.

In step 1430, in response to the detection of the change in the operating condition of the multipole assembly, a piezoelectric actuator is actuated to adjust a position of an electrode included in the plurality of elongate electrodes based on the detected change in the operating condition. This may be performed in any of the ways described herein, such as by applying a DC control voltage to the piezoelectric actuator to adjust the position of the electrode based on a detected change in temperature or a detected change in position of an electrode. The position of the electrode may be adjusted in any direction(s) as described herein.

Figure 15:
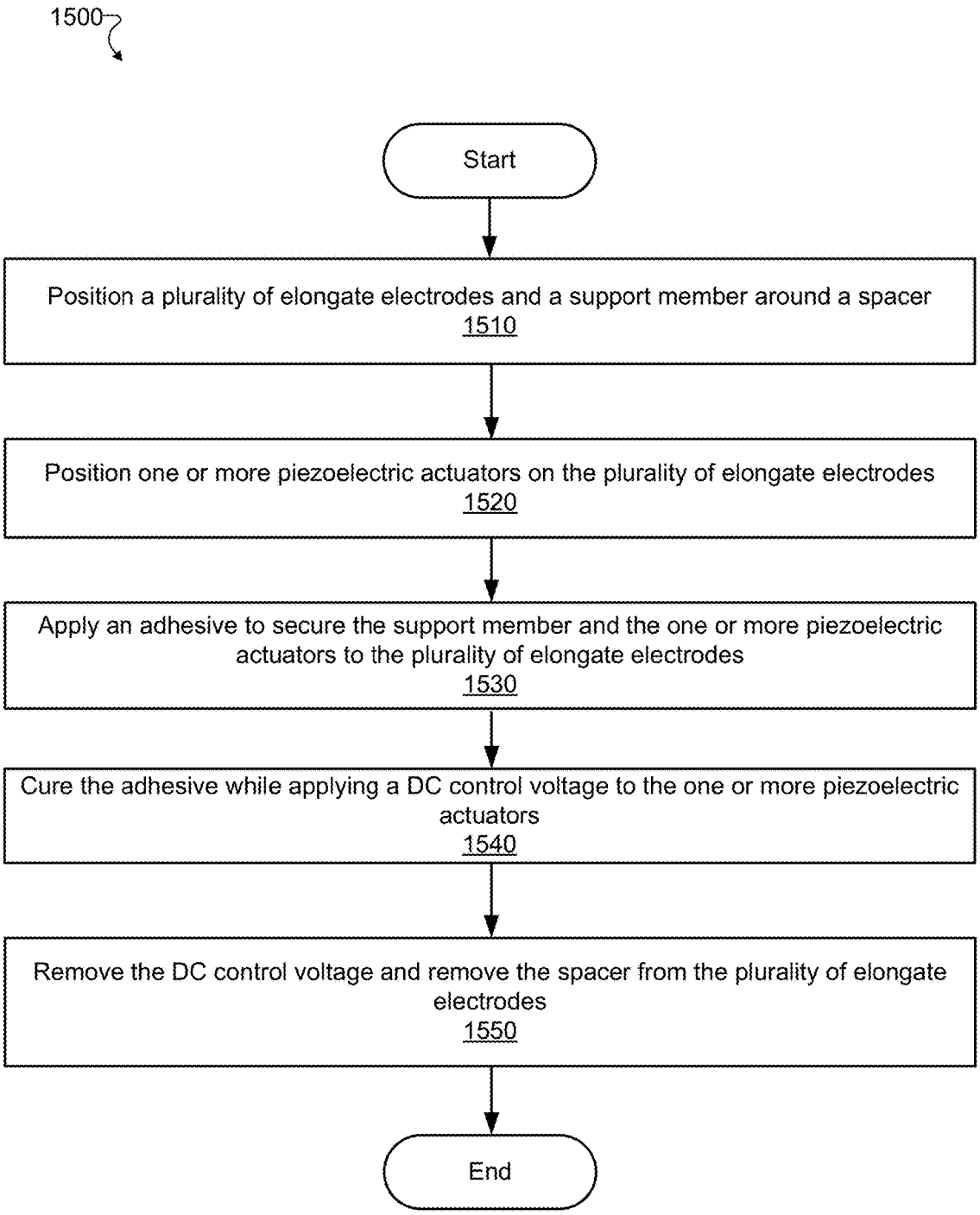
FIGS. 15-16 illustrate an exemplary method of making a multipole assembly according to principles described herein.

FIG. 15 illustrates an exemplary method 1500 of making a multipole assembly. While FIG. 15 identifies exemplary steps according to one embodiment, other embodiments may omit, add to, reorder, combine, and/or modify any of the steps shown in FIG. 15.

Figure 16:
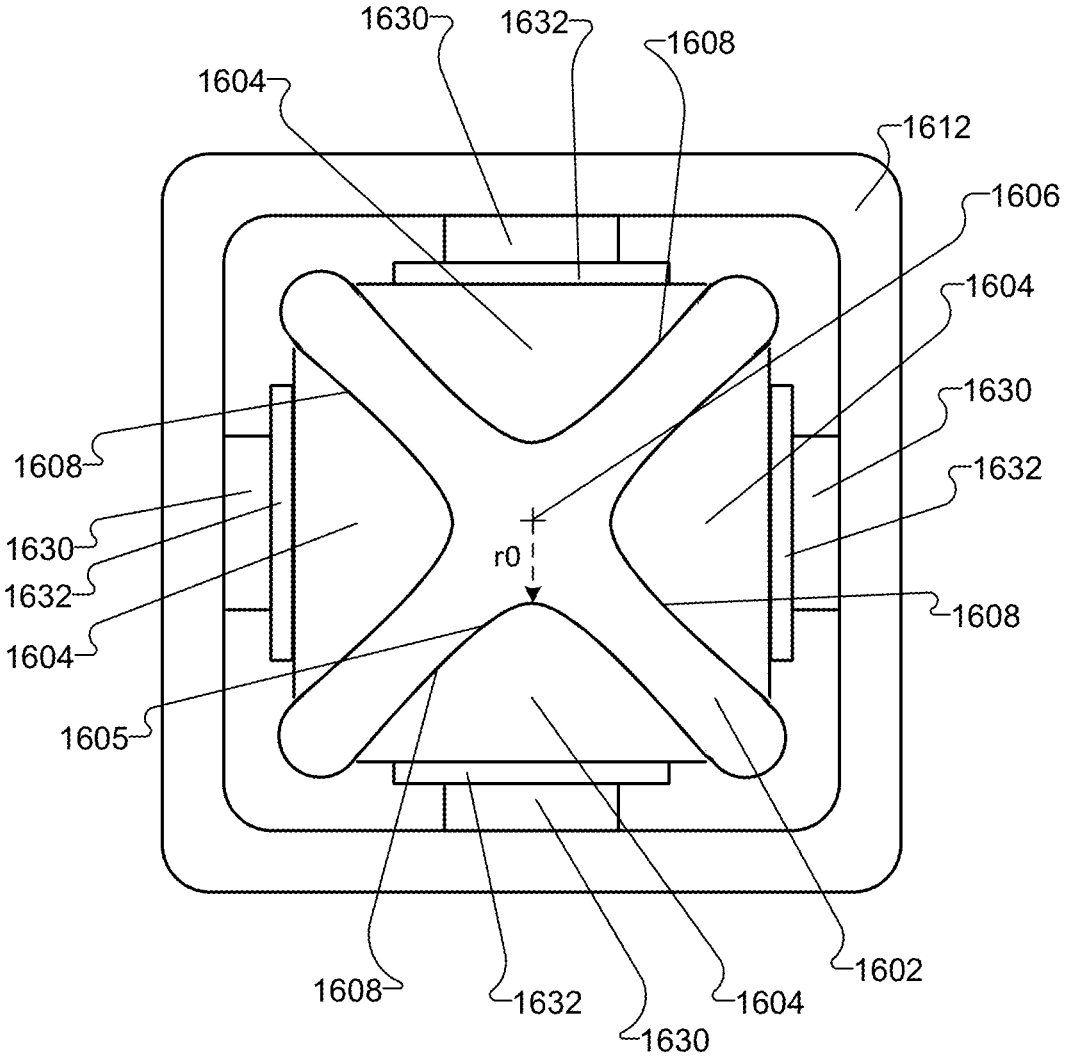

In step 1510, a plurality of elongate rod electrodes and a support member are positioned around a spacer. FIG. 16 illustrates an exemplary spacer 1602 that may be used to form a quadrupole (e.g., quadrupole 502, see FIG. 5). As shown, spacer 1602 is an elongate member configured to support a plurality of elongate rod electrodes 1604 arranged about an axis 1606 along a longitudinal trajectory of electrodes 1604. Spacer 1602 includes a plurality of elongate grooves 1608 corresponding to electrodes 1604 to facilitate positioning of electrodes 1604. Grooves 1608 may have a cross-sectional shape (e.g., hyperbolic, circular, elliptical, flat, etc.) and size to match and fit the cross-sectional shape and size of facing surfaces 1605 of electrodes 1604 to thereby maintain the alignment of electrodes 1604.

Returning to FIG. 15, in step 1520, one or more piezoelectric actuators 1630 are positioned on electrodes 1604. Piezoelectric actuators 1630 may be positioned on electrodes 1604 in any configuration and any arrangement described herein. As shown in FIG. 16, a piezoelectric actuator 1630 may be positioned on each electrode 1604 between support member 1612 and electrodes 1604. Insulators 1632 may be positioned to electrically isolate piezoelectric actuators 1630 from electrodes 1604, as may suit a particular implementation.

Returning again to FIG. 15, in step 1530, an adhesive is applied to secure support member 1612 and/or piezoelectric actuators 1630 to the plurality of electrodes 1604. For example, the adhesive may be applied to gaps between support member 1612 and piezoelectric actuators 1630, and to gaps between piezoelectric actuators 1630 and electrodes 1604. The adhesive may be any suitable adhesive, such as an epoxy adhesive that hardens when cured.

Returning again to FIG. 15, in step 1540, the adhesive is cured while a DC control voltage is applied to one or more of the piezoelectric actuators 1630. The adhesive may be cured by any suitable means, such as by irradiation with ultraviolet (UV) light. The DC control voltage is configured to actuate piezoelectric actuators 1630 to adjust a position of electrodes 1604 toward spacer 1602. The DC control voltage may be any voltage up to a maximum rated operating voltage, but is preferably a mid-level voltage. For example, if a maximum rated operating voltage of piezoelectric actuators 1630 is 150 V, the DC control voltage may be more than 0 V up to 150 V, preferably approximately 50 V-100 V (⅓ up to ⅔ of the maximum rated operating voltage), and more preferably about 75 V. The DC control voltage that is applied during assembly can be recorded and stored, such as in a storage device or memory of controller 108.

In step 1550, spacer 1602 is removed from the plurality of electrodes 1604 after the adhesive has cured. This is done by first removing the DC control voltage from the piezoelectric actuators 1630, thereby relaxing the grip of electrodes 1604 on spacer 1602. Spacer 1602 can then be removed from the plurality of electrodes 1604.

By actuating one or more piezoelectric actuators 1630 during curing of the adhesives, the "rest" position of the electrodes 1604 (i.e., the position of electrodes 1604 when no DC control voltage is applied to piezoelectric actuators 1630) has an $r_0$ value slightly larger than the target or desired $r_0$ value, where $r_0$ is the distance from axis 1606 to facing surfaces 1605 of electrodes 1604. Thus, spacer 1602 can be removed easily without disrupting the alignment of electrodes 1604. During operation of the multipole assembly thus formed, the DC control voltage can be applied to piezoelectric actuators 1630 to adjust the position of electrodes 1604 to achieve the target $r_0$ value.

While a method of assembling a multipole assembly similar to quadrupole 502 (see FIG. 5) has just been described, the method is not limited to such a configuration. The method described herein can be modified and applied to manufacture and assembly of any multipole assembly described herein, including but not limited to quadrupole 202 (see FIGS. 2-4), quadrupole 602 (see FIG. 6), and quadrupole 702 (see FIGS. 7-9).

In certain embodiments, one or more of the systems, components, and/or processes described herein may be implemented and/or performed by one or more appropriately configured computing devices. To this end, one or more of the systems and/or components described above may include or be implemented by any computer hardware and/or computer-implemented instructions (e.g., software) embodied on at least one non-transitory computer-readable medium configured to perform one or more of the processes described herein. In particular, system components may be implemented on one physical computing device or may be implemented on more than one physical computing device. Accordingly, system components may include any number of computing devices, and may employ any of a number of computer operating systems.

In certain embodiments, one or more of the processes described herein may be implemented at least in part as instructions embodied in a non-transitory computer-readable medium and executable by one or more computing devices. In general, a processor (e.g., a microprocessor) receives instructions, from a non-transitory computer-readable medium, (e.g., a memory, etc.), and executes those instructions, thereby performing one or more processes, including one or more of the processes described herein. Such instructions may be stored and/or transmitted using any of a variety of known computer-readable media.

A computer-readable medium (also referred to as a processor-readable medium) includes any non-transitory medium that participates in providing data (e.g., instructions) that may be read by a computer (e.g., by a processor of a computer). Such a medium may take many forms, including, but not limited to, non-volatile media, and/or volatile media. Non-volatile media may include, for example, optical or magnetic disks and other persistent memory. Volatile media may include, for example, dynamic random access memory ("DRAM"), which typically constitutes a main memory. Common forms of computer-readable media include, for example, a disk, hard disk, magnetic tape, any other magnetic medium, a compact disc read-only memory ("CD-ROM"), a digital video disc ("DVD"), any other optical medium, random access memory ("RAM"), programmable read-only memory ("PROM"), electrically erasable programmable read-only memory ("EPROM"), FLASH-EEPROM, any other memory chip or cartridge, or any other tangible medium from which a computer can read.

Figure 17:
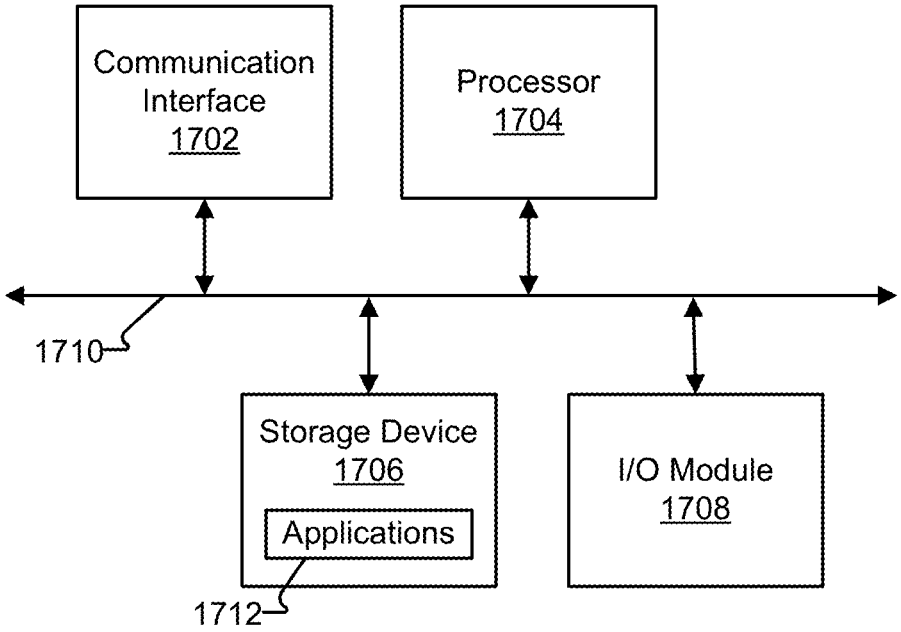
FIG. 17 illustrates an exemplary computing system according to principles described herein.

FIG. 17 illustrates an exemplary computing device 1700 that may be specifically configured to perform one or more of the processes described herein. As shown in FIG. 17, computing device 1700 may include a communication interface 1702, a processor 1704, a storage device 1706, and an input/output ("I/O") module 1708 communicatively connected via a communication infrastructure 1710. While an exemplary computing device 1700 is shown in FIG. 17, the components illustrated in FIG. 17 are not intended to be limiting. Additional or alternative components may be used in other embodiments. Components of computing device 1700 shown in FIG. 17 will now be described in additional detail.

Communication interface 1702 may be configured to communicate with one or more computing devices. Examples of communication interface 1702 include, without limitation, a wired network interface (such as a network interface card), a wireless network interface (such as a wireless network interface card), a modem, an audio/video connection, and any other suitable interface.

Processor 1704 generally represents any type or form of processing unit capable of processing data or interpreting, executing, and/or directing execution of one or more of the instructions, processes, and/or operations described herein. Processor 1704 may direct execution of operations in accordance with one or more applications 1712 or other computer-executable instructions such as may be stored in storage device 1706 or another computer-readable medium.

Storage device 1706 may include one or more data storage media, devices, or configurations and may employ any type, form, and combination of data storage media and/or device. For example, storage device 1706 may include, but is not limited to, a hard drive, network drive, flash drive, magnetic disc, optical disc, RAM, dynamic RAM, other non-volatile and/or volatile data storage units, or a combination or sub-combination thereof. Electronic data, including data described herein, may be temporarily and/or permanently stored in storage device 1706. For example, data representative of one or more executable applications 1712 configured to direct processor 1704 to perform any of the operations described herein may be stored within storage device 1706. In some examples, data may be arranged in one or more databases residing within storage device 1706.

I/O module 1708 may include one or more I/O modules configured to receive user input and provide user output. One or more I/O modules may be used to receive input for a single virtual reality experience. I/O module 1708 may include any hardware, firmware, software, or combination thereof supportive of input and output capabilities. For example, I/O module 1708 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1708 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1708 is configured to provide graphical data to a display for presentation to a user. The graphical data may be representative of one or more graphical user interfaces and/or any other graphical content as may serve a particular implementation.

In some examples, controller 108 (see FIG. 1) may be implemented by or within one or more components of computing device 1700. For example, one or more applications 1712 residing within storage device 1706 may be configured to direct processor 1704 to perform one or more processes or functions associated with controller 108 of system 100. Likewise, a storage device or memory of system 100 or controller 108 may be implemented by storage device 1706 or a component thereof. In some examples, storage device 1706 may be a ROM chip coupled to an end of a ribbon cable (or other lead wire) that is communicatively coupled to one or more piezoelectric actuators of a multipole assembly. The ribbon cable may be configured to supply a DC control voltage to the one or more piezoelectric actuators. The data stored by the ROM chip may include, but is not limited to, calibration values, predetermined baseline values of force data, one or more LUTs (e.g., a temperature change LUT, a force data LUT, etc.), DC control voltage data, and the like. In some examples, the data stored by a particular ROM chip is tailored to the particular multipole assembly to which the ROM chip is coupled. Controller 108 may access the data stored on the ROM chip to calibrate the multipole assembly and adjust the alignment of the multipole assembly and/or one or more electrodes included in the multipole assembly.

It will be recognized by those of ordinary skill in the art that while the foregoing description refers to multipole assemblies having four electrodes, embodiments of the invention may be beneficially utilized in connection with multipole assemblies having a larger number of electrodes, e.g., hexapole or octapole assemblies having six and eight electrodes, respectively.

More generally, in the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A multipole assembly configured to be disposed in a mass spectrometer, the multipole assembly comprising:

a plurality of elongate electrodes arranged about an axis extending along a longitudinal trajectory of the plurality of elongate electrodes and configured to confine ions radially about the axis, and a piezoelectric actuator configured to adjust a position of a first electrode included in the plurality of elongate electrodes.

2. The multipole assembly of claim 1, wherein the piezoelectric actuator is configured to adjust a parallel alignment of the first electrode with respect to a second electrode included in the plurality of elongate electrodes.

3. The multipole assembly of claim 1, wherein the multipole assembly forms all or part of an ion guide, a mass filter, a collision cell, or an ion trap.

4. The multipole assembly of claim 1, wherein the first electrode and a second electrode included in the plurality of elongate electrodes are separated from each other across the axis along a first direction, and the piezoelectric actuator is configured to adjust the position of the first electrode substantially along the first direction.

5. The multipole assembly of claim 4, wherein the piezoelectric actuator comprises a shear stack and is further configured to adjust the position of the first electrode along another direction substantially orthogonal to the first direction.

6. The multipole assembly of claim 4, further comprising:

an additional piezoelectric actuator configured to adjust a position of a third electrode included in the plurality of elongate electrodes.

7. The multipole assembly of claim 6, wherein the third electrode and a fourth electrode included in the plurality of elongate electrodes are separated from each other across the axis along a second direction substantially orthogonal to the first direction, and the additional piezoelectric actuator is configured to adjust the position of the third electrode substantially along the second direction.

8. The multipole assembly of claim 1, further comprising:

an insulator configured to electrically insulate the piezoelectric actuator from the plurality of elongate electrodes.

9. The multipole assembly of claim 1, wherein the piezoelectric actuator is shielded from an electrical field generated by the plurality of elongate electrodes.

10. The multipole assembly of claim 1, wherein the piezoelectric actuator is under an axial preload.

11. The multipole assembly of claim 1, further comprising a support member configured to hold the plurality of elongate electrodes about the axis, wherein the piezoelectric actuator is positioned between the support member and the first electrode.

12. The multipole assembly of claim 1, further comprising a support member configured to hold the plurality of elongate electrodes about the axis, wherein the support member is positioned between the piezoelectric actuator and the first electrode, and the piezoelectric actuator is configured to adjust the position of the first electrode by at least one of deforming the support member and adjusting a position of the support member.

13. The multipole assembly of claim 1, wherein the piezoelectric actuator is configured to adjust the position of the first electrode to adjust at least one of a concentricity alignment and an angular alignment of the multipole assembly with an incoming ion beam or an ion detector.

14. The multipole assembly of claim 1, wherein the piezoelectric actuator is configured to adjust the position of the first electrode to adjust a longitudinal alignment of the first electrode with respect to a second electrode included in the plurality of elongate electrodes.

15. The multipole assembly of claim 1, further comprising:

a first printed circuit board and a second printed circuit board positioned opposite one another with a gap therebetween, wherein the first electrode is arranged on the first printed circuit board, and the piezoelectric actuator is configured to adjust the position of the first electrode by adjusting the position of the first printed circuit board.

16. The multipole assembly of claim 15, wherein the piezoelectric actuator is configured to adjust a parallel alignment of the first printed circuit board with respect to the second printed circuit board by adjusting a position of the first printed circuit board.

17. A mass spectrometer, comprising:

an ion source configured to produce ions from a sample;

a mass analyzer configured to filter the ions produced from the sample, the mass analyzer comprising:

a multipole assembly having a plurality of electrodes arranged about an axis extending along a longitudinal trajectory of the plurality of elongate electrodes and configured to confine the ions radially about the axis, and a piezoelectric actuator configured to adjust a position of a first electrode included in the plurality of electrodes; and a detector configured to detect ions delivered from the mass analyzer.

18. The mass spectrometer of claim 17, further comprising:

an oscillatory voltage power supply coupled to the plurality of electrodes and configured to supply an RF voltage to the plurality of electrodes;

a DC power supply coupled to the piezoelectric actuator and configured to supply a DC control voltage to the piezoelectric actuator; and a controller coupled to the oscillatory voltage power supply and the DC power supply and configured to:

control the oscillatory voltage power supply to supply the RF voltage to the plurality of electrodes, and control the DC power supply to supply the DC control voltage to the piezoelectric actuator to adjust the position of the first electrode.

19. The mass spectrometer of claim 18, wherein the controller is configured to control the DC power supply to supply the DC control voltage to the piezoelectric actuator by:

accessing, from a storage device communicatively coupled to the controller, a predetermined calibration value indicative of a DC voltage level configured to bring the first electrode into a preset alignment with a second electrode included in the plurality of elongate electrodes, and adjusting the DC control voltage to the predetermined calibration value.

20. The mass spectrometer of claim 18, wherein:

the DC power supply is further coupled to the plurality of electrodes and configured to supply a mass resolving DC voltage to the plurality of electrodes, and the controller is further configured to control filtering of the ions produced from the sample based on a ratio of mass to charge of the ions by controlling the oscillatory voltage power supply and the DC power supply to supply, to the plurality of electrodes, a range of RF voltages and mass resolving DC voltages over time during a scan of a range of ratios of mass to charge, and dynamically vary the position of the first electrode by controlling the DC power supply to vary, over time during the scan of the range of ratios of mass to charge, the DC control voltage supplied to the piezoelectric actuator.

21. The mass spectrometer of claim 17, further comprising:

a sensor configured to detect an operating condition of the multipole assembly, wherein the controller is configured to:

detect a change in the operating condition of the multipole assembly, and actuate, in response to the detection of the change in the operating condition of the multipole assembly, the piezoelectric actuator to adjust the position of the first electrode.

22. The mass spectrometer of claim 21, wherein the sensor comprises at least one of a temperature sensor configured to detect a temperature of the multipole assembly, a strain gauge configured to detect the position of the first electrode, and a piezoelectric transducer configured to detect the position of the first electrode.

23. A method of operating a mass spectrometer having a multipole assembly comprising a plurality of elongate electrodes arranged about an axis extending along a longitudinal trajectory of the plurality of elongate electrodes and configured to confine ions radially about the axis, and a piezoelectric actuator configured to adjust a position of a first electrode included in the plurality of elongate electrodes, the method comprising:

actuating the piezoelectric actuator to adjust the position of the first electrode.

24. The method of operating the mass spectrometer of claim 23, further comprising:

filtering ions produced from a sample based on a ratio of mass to charge of the ions by applying a range of RF voltages and mass resolving DC voltages over time to the plurality of elongate electrodes during a scan of a range of ratios of mass to charge, wherein the actuating of the piezoelectric actuator comprises applying a DC control voltage to the piezoelectric actuator during the scan of the range of ratios of mass to charge.

25. The method of operating the mass spectrometer of claim 24, further comprising:

detecting a change in temperature of the multipole assembly, and changing, in response to detection of the change in temperature of the multipole assembly, the DC control voltage applied to the piezoelectric actuator during the scan of the range of ratios of mass to charge.

* * * * *